US006506092B1

(12) United States Patent
Kuracina et al.

(10) Patent No.: US 6,506,092 B1
(45) Date of Patent: Jan. 14, 2003

(54) METHOD AND APPARATUS FOR ENHANCING AN APPLAUSE

(75) Inventors: Thomas C. Kuracina, Ojai; Randall E. Ohnemus, Ventura, both of CA (US)

(73) Assignee: Intune Corporation, Ventura, CA (US)

( * ) Notice: Subject to any disclaimer, the term of this patent is extended or adjusted under 35 U.S.C. 154(b) by 0 days.

(21) Appl. No.: 09/624,710

(22) Filed: Jul. 25, 2000

Related U.S. Application Data

(63) Continuation-in-part of application No. 09/176,016, filed on Oct. 20, 1998.

(60) Provisional application No. 60/069,650, filed on Dec. 9, 1997, and provisional application No. 60/062,841, filed on Oct. 29, 1997.

(51) Int. Cl.[7] ..... A63H 5/00; A45F 5/10; B65D 23/10; B65D 25/28

(52) U.S. Cl. ..... 446/81; 215/396; 220/738; 220/759; 294/165; 446/77; 446/404; 446/418

(58) Field of Search ..... 215/395, 396; 220/737, 738, 741, 752, 759; 294/28, 165; 446/71, 76, 77, 79, 80, 81, 404, 418

(56) References Cited

U.S. PATENT DOCUMENTS

| | | | | | |
|---|---|---|---|---|---|
| 419,560 | A | * | 1/1890 | Rice | |
| 592,781 | A | | 11/1897 | Hertwig | |
| 869,886 | A | | 11/1907 | Duckworth | |
| 1,089,425 | A | | 3/1914 | Meyer | |
| 1,159,491 | A | * | 11/1915 | Graham | |
| 1,239,204 | A | | 9/1917 | Meyer | |
| 1,866,493 | A | | 7/1932 | Staats | |
| 1,982,888 | A | | 12/1934 | Tsukamoto | 84/402 |
| 2,107,981 | A | | 2/1938 | Ford | 46/175 |
| 2,122,628 | A | | 7/1938 | Tracy | 65/61 |
| 3,353,729 | A | | 11/1967 | Hull | 224/45 |
| 3,592,501 | A | | 7/1971 | Stokes et al. | 294/32 |
| 4,034,926 | A | * | 7/1977 | Wegner | |
| 4,606,523 | A | | 8/1986 | Statz et al. | 248/311.2 |
| 4,810,228 | A | * | 3/1989 | Huggins | 446/418 |
| 4,928,873 | A | * | 5/1990 | Johnson | 220/738 |
| 5,098,327 | A | * | 3/1992 | Ferrero | 446/75 |
| 5,213,504 | A | * | 5/1993 | Lee et al. | 434/84 |
| 5,558,246 | A | * | 9/1996 | Ross | 220/737 |
| 5,984,761 | A | * | 11/1999 | Kalinowski | 446/421 |

* cited by examiner

*Primary Examiner*—John A. Ricci
(74) *Attorney, Agent, or Firm*—Stetina Brunda Garred & Brucker

(57) ABSTRACT

A method and apparatus for enhancing an applause is described. The present invention acts as a container for food or beverages and once the food or beverage is consumed may be converted into an apparatus to enhance an applause or boo. One embodiment of the present invention is an apparatus for holding a beverage container. The apparatus for holding the beverage container has a top, a bottom, and at least two sidewall sections which may be selectively detached and assembled with matching components. The device may be selectively adjustable to accommodate containers of various sizes and shapes. By detaching the sidewall sections in at least one place the sidewall sections may be open and closed. The open and closing motion may be done such that when the sidewall sections are closed upon one another they hit to make an audible sound.

10 Claims, 25 Drawing Sheets

FIG. AA

METHOD AND APPARATUS FOR ENHANCING AN APPLAUSE

CROSS-REFERENCE TO RELATED APPLICATIONS

This patent application is a continuation-in-part of U.S. patent application Ser. No. 09/176,016 filed on Oct. 20, 1998 entitled METHOD AND APPARATUS FOR ENHANCING AN APPLAUSE which is related to U.S. Provisional Patent Applications No. 60/069,650 (filed Dec. 9, 1997) and No. 60/062,841 (filed Oct. 29, 1997) both entitled METHOD AND APPARATUS FOR ENHANCING AN APPLAUSE, the contents of which are hereby incorporated by reference.

STATEMENT RE: FEDERALLY SPONSORED RESEARCH/DEVELOPMENT (Not Applicable)

BACKGROUND OF THE INVENTION

The present invention relates to a method and apparatus for creating a sound or noise, or enhancing an applause, and more particularly to a device capable of creating, generating, projecting or amplifying an audible sound, allowing a person or spectator to expend a minimal amount of energy to create noise or applause, while maintaining or increasing an applause sound level.

The applause enhancing device may also include a means for holding a beverage or food, or a beverage or food container, may also include a self-adjusting means to accommodate different size and configuration containers. The applause enhancing device may also include a means to combine two separate colored sections together. The present invention may also provide an insulating means to keep food or a beverage at a desired temperature. The present invention is also related to goods and packaging where a mark, message or the like can be easily read from a first orientation or perspective, with a second message being selectively concealed when the goods or container are viewed from the first perspective, yet the second message is viewable when observed from a second orientation or perspective.

Spectators in an audience normally express approval of a performance or performer by creating an audible sound known as an applause. An audience can consist of only one spectator, or a large number of viewers. An applause is typically created by striking the hands together to generate an audible sound known as a "handclap". A handclap is normally created by positioning the fingers of the first hand together where they form a row and are touching each other, and flatly striking the palm of the opposite hand. A handclap is also generated by striking palm to palm or fingers to fingers.

An applause is the most commonly used method to demonstrate appreciation or approval of a performer or performance. Conversely, spectators show disapproval to a performer or performance by booing, and a boo may be voiced as intensely and passionately as an applause. In any event, the audience's reaction to a performer or performance is indicated by a noise or audible sound. Applauding is not limited to handclapping, but includes vocal sounds like talking or shouting, foot stomping and sounds made by a variety of other noise making actions or devices The dynamics involved in projecting a noise from striking two elements together, like the hands, is simple and creates a sharp, audible sound. Sound is a vibration, or series of vibrations, traveling through air or fluid. A sound is normally perceived by a hearing organ as an auditory sensation. Sound is also felt as a vibratory sensation.

While normal clapping produces a satisfactory level of sound, prolonged or repeated clapping can produce swelling and irritation of the hand tissue. The pain created by repeated handclapping also results in a diminished desire by an audience or spectator to clap or applause.

Temperature also plays a factor in an audience's ability to generate a handclap. When an event is held outside in cold weather, fans and spectators must dress in heavier weight clothes to protect the body from the cold elements. Gloves are normally worn in cold weather and greatly inhibit a spectator's ability to generate an audible applause with their hands. One must either remove their gloves or mittens to generate a loud handclap, or clap with their gloves on, that produces a muffled clap. Spectators then must shout to generate a desired applause.

Spectators also use their voices to applause or boo, and normally raise their voice or shout during an event. Many spectators cup their hands around their mouth to create a megaphone-like configuration to aim the sound in a desired direction. While normal shouting produces a satisfactory level of sound, prolonged or repeated shouting can produce loss of voice and irritation of the throat tissue. The pain created by repeated shouting also results in a diminished desire by an audience or spectator to shout.

Athletic teams and schools all have designated team colors that usually consist of two colors. The applause enhancing apparatus of the present invention may be integrally manufactured in a plurality of colors to create the team, or school colors. The applause enhancing apparatus of the present invention may also be selectively separated, or broken apart, then assembled combining a two different colors to create the team, or school colors.

Some examples of prior art devices used to create an applause are drums, noise making devices, wind instruments, rattles and megaphones. A simple noise making device is taught by Kerr in U.S. Pat. No. 4,463,517 where a multi-paddled apparatus on a central post is moved back and forth to generate a noise. The use of the Kerr invention does not replicate a normal handclapping motion. Other paddle-related devices are taught in U.S. Pat. No. D378,384 by Gilbert, and U.S. Pat. No. D351,627 by Beckwith, but are limited to a paddle and lack features that could be useful to a spectator at an event, like a sound chamber or a means to project a voice, hold a food or beverage product, or a food or beverage container, or display the team colors.

A number of attempts have also been made to combine a megaphone and cup together as taught in U.S. Pat. No. 5,501,363 by Muller et al., U.S. Pat. No. 4,125,218 by DeBoer, and U.S. Pat. No. 4,618,066 by Vail where a beverage is placed directly in the inner cavity of the cup. A liquid-tight seal is then needed to properly contain a liquid in the cup, and the separate closing cap must be removed prior to using the cup as a megaphone. The reusable closing cap or caps can be easily misplaced during the course of the event. A certified, food-grade material or plastic must also be used in any apparatus where the food or beverage comes in direct contact with the apparatus.

FIG. 1 shows a prior art container 110 that is used to hold a food or beverage comprising an inner cavity 113 and a base or foot 112. As illustrated, the container is fillable with food or a beverage and is grippable by a hand. Many prior art containers include indicia or advertisements.

FIG. 2 illustrates a cross sectional view of prior art container 110 of FIG. 1 comprising an inner cavity 113, a base or foot 112 and a bottom 111. The prior art container 110 functions well as a container, is stackable, and is usually made as a disposable product at the lowest cost possible. A cold or hot beverage placed in such a container quickly loses its desired temperature.

FIG. 17 shows a cut away view of a prior art insulated container or cup holder 11 having a bottom 12 holding a beverage container or can 10. A bottle or food container may also be held by the holder 11. Many prior art cup holders also may include indicia or advertisements.

FIG. 26 shows a full side view of a prior art container or cupholder 211 having a mark or indicia 219 where the cupholder is holding a beverage container or can 10 having a poptop opening 13. A bottle or food container may also be held by the holder 211.

Typical food or beverage containers are produced in very large volumes, are disposable, and may include recycled or recyclable materials.

What is needed is an apparatus and method for enhancing an applause, that also may serve as a beverage or food container, or may hold a food or beverage container and may include, individually or in combination, a means for creating, projecting or amplifying a sound, an insulating means, a holding means, a gripping means, a hinging means, a biasing means, a releasing means, a joining means, an opening means, a limiting means, a means to combine two separately colored sections together to create a team's colors, an identifying mark, indicia, message or advertisement that is viewable from a first perspective, and a "hidden" or concealed mark, indicia, message or advertisement that is viewable from a second perspective, and that solves the aforementioned problems.

What is needed is a method and apparatus for enhancing an applause or boo that is simple to use, creates a desirable sound level and has a low manufacturing cost. Additionally, it may be desirable for an applause enhancing device to include a number of other features, individually or in combination, such as: a container for holding a food or beverage; a holder for holding a food or beverage container; an insulating means; a mark, indicia or advertisement for promoting an event, league, group or team; as well a means for projecting or amplifying a voice or creating a sound. A biasing means may also be included in the applause enhancing apparatus where a means biases the sections toward an open position, or a closed position.

BRIEF SUMMARY OF THE INVENTION

The foregoing objects have been achieved by the applause enhancing apparatus of the present invention by providing a means to create an audible sound.

In another embodiment, an applause enhancing device is provided that is removably attached to a container.

In another embodiment, an applause enhancing device is provided that is grippable with a hand.

In another embodiment, an applause enhancing device is provided that includes a projection, tensioning member, biasing member, or resilient member to move an applause enhancing apparatus from a first position to a second position.

In another embodiment, an applause enhancing device is provided that includes a biasing means to move an applause enhancing apparatus from a first position to a second position.

In one embodiment, an applause enhancing device is provided that is movable from a first position to a second position whereby an audible sound is generated when two sections strike together.

In another embodiment, an applause enhancing device is provided that is movable from a first non-contacting position to a second contacting position whereby an audible sound is generated when two sections strike together then is biased back to a third non-contacting position.

In another embodiment, an applause enhancing device is provided that is a container.

In another embodiment, an applause enhancing device is provided that is a food or beverage container holder.

In another embodiment, an applause enhancing device is provided that is a food or beverage container holder that is openable, yet remains joined together when a food or beverage container is placed within the holder In another embodiment, an applause enhancing device is provided that is a container having an insulating means.

In yet another embodiment, an applause enhancing device is provided that is a container having a plurality of sections.

In still another embodiment, an applause enhancing device is provided that is a container having a handle.

In still another embodiment, an applause enhancing device is provided that is a container holder having a handle.

In another embodiment, an applause enhancing device is provided with a mark or indicia.

In yet another embodiment, an applause enhancing device is provided with a hinge.

In another embodiment, an applause enhancing device is provided that includes at least one aperture in the bottom wall section.

In another embodiment, an applause enhancing device is provided that includes a plurality of sections that are selectively joinable.

In another embodiment, an applause enhancing device is provided that includes a plurality of sections that are selectively separable.

In another embodiment, an applause enhancing device is provided where the sections of two different colored devices can be separated prior to coupling the corresponding sections together, then a multi-colored device may be created by combining two different colored sections together.

In another embodiment, an applause enhancing device is provided that may include a means for holding a container having a change in profile.

In another embodiment, an applause enhancing device is provided that may include a means for holding different sized containers.

In another embodiment, an applause enhancing device is provided that may include a separate means for holding different sized containers.

In another embodiment, an applause enhancing device is provided that may include an adjustable means for holding different sized containers.

In another embodiment, an applause enhancing device is provided that may include a means to hold a can or bottle.

In another embodiment, a container is provided that has an identifying mark viewable from a first perspective, and a second, hidden mark being viewable from a second perspective.

In another embodiment, a container is provided where an indicia, message, logo or advertisement may be easily read from a first orientation, with a second message being selectively concealed when the present invention is viewed from a first perspective, yet a second message is viewable when observed from a second orientation or perspective.

In yet another embodiment, a container is provided where a mark, indicia, message, logo or advertisement is selectively concealed when the container contains a food or beverage, yet the mark, indicia, message or advertisement is viewable when the contents of a container are removed from the container.

In still another embodiment, an applause enhancing device is provided where a mark, indicia, message, logo or advertisement may be easily read from a first orientation, with a second mark, indicia, message or advertisement being selectively concealed when the present invention is viewed from the first perspective, yet the second message is viewable when observed from a second orientation or perspective.

In another embodiment, a noise making apparatus is provided that may be worn on the hand or finger.

In yet another embodiment, a noise making apparatus is provided that may be worn on the hand or finger and may be struck against another object to create a sound.

In one embodiment, a noise making apparatus is provided that comprises a means to hold a food or beverage.

In one embodiment, a noise making apparatus is provided that comprises a means to hold a food or beverage and is a megaphone.

In one embodiment, a noise making apparatus is provided that comprises a means to hold a food or beverage and is a clapper.

In one embodiment, a noise making apparatus is provided that comprises a means to hold a food or beverage and is a clapper with a sound chamber.

In another embodiment, a noise making apparatus is provided that comprises a holder to hold a food or beverage container.

In another embodiment, a noise making apparatus is provided that comprises a holder to hold a food or beverage container and is a megaphone.

In another embodiment, a noise making apparatus is provided that comprises a holder to hold a food or beverage container and is a clapper.

In another embodiment, a noise making apparatus is provided that comprises a holder to hold a food or beverage container and is a clapper with a sound chamber.

In another embodiment, a noise making apparatus is provided that comprises a holder to hold a food or beverage container and adjusts to hold different sized or shaped containers.

In another embodiment, a noise making apparatus is provided that comprises a holder to hold a food or beverage container and includes a separate component that allows the noise making apparatus to hold different sized or shaped containers.

In one embodiment, a noise making apparatus is provided having a hinged handle.

In another embodiment a noise making apparatus is provided having a hinged body.

In one embodiment, a noise making apparatus is provided having a sound chamber with at least one open end.

In one embodiment, a noise making apparatus is provided having a sound chamber with a plurality of openings.

In another embodiment, a food or beverage holding apparatus is provided having a body to hold a food or beverage container.

In another embodiment a noise making apparatus is provided having a uniform wall section thickness.

In another embodiment a noise making apparatus is provided having two corresponding sections.

In another embodiment a noise making apparatus is provided having two separate sections that may be joined together.

In yet another embodiment a noise making apparatus is provided being manufacturable by injection molding processes.

In still another embodiment a noise making apparatus is provided being manufacturable by injection molding processes in an open face configuration.

In one embodiment a noise making apparatus is provided being stackable.

In one embodiment, a noise making apparatus is provided that comprises a means to hold a food or beverage and a means to open or remove the bottom of the container.

In one embodiment, a noise making apparatus is provided that comprises a means to hold a food or beverage and a means to seal the bottom of the container in a liquid-tight manner.

In another embodiment, a noise making apparatus is provided that comprises a means to hold a food or beverage and a means to open or remove the sealed, liquid-tight bottom of the container.

In one embodiment, an applause enhancing apparatus is provided that includes a biasing means to urge the sections of the apparatus towards a non-contacting position.

In one embodiment, an applause enhancing apparatus is provided that includes a biasing means to urge the sections of the apparatus towards an open position.

In another embodiment, an applause enhancing apparatus is provided that includes a biasing means to urge the sections of the apparatus towards a closed position.

In another embodiment, an applause enhancing apparatus is provided that includes a mechanical means to maintain the sections of the apparatus adjacent to each other when an object or cup is inserted into the apparatus.

In another embodiment, an applause enhancing apparatus is provided that includes a mechanical means to maintain the sections of the apparatus away from each other when an object or cup is inserted into the apparatus.

In another embodiment, an applause enhancing apparatus is provided that includes a mechanical means to urge the sections of the apparatus apart, relative to each other, when an object or cup is removed from the apparatus.

Wherefore, it is an object of the present invention to provide an applause enhancing apparatus and method that creates an audible sound.

It is another object of the invention to provide an applause enhancing apparatus and method that replaces or enhances a handclap.

It is another object of the invention to provide an applause enhancing apparatus and method that prevents hand tissue irritation or damage associated with prolonged handclapping.

It is another object of the invention to provide an applause enhancing apparatus that is inexpensive to manufacture and is easy to use.

It is also an object of the invention to provide an applause enhancing apparatus that may include an identifying mark, indicia, logo, message or advertisement.

It is another object of the invention to provide an applause enhancing apparatus and method that is grippable by a hand.

It is yet another object of the invention to provide an applause enhancing apparatus and method that is unitarily manufactured.

It is yet another object of the invention to provide an applause enhancing apparatus and method that comprises a plurality of sections.

It is another object of the invention to provide an applause enhancing apparatus and method that includes a hinge.

It is yet another object of the invention to provide an applause enhancing apparatus and method that includes a handle.

It is still another object of the invention to provide an applause enhancing apparatus and method with a handle that includes a hinge.

It is yet another object of the invention to provide an applause enhancing apparatus and method that includes a plurality of sections that are selectively joinable.

It is yet another object of the invention to provide an applause enhancing apparatus and method that includes a plurality of sections that are selectively separable.

It is still a further object of the invention to provide an applause enhancing apparatus and method that is removably attachable to a container.

It is still another object of the invention to provide an applause enhancing apparatus and method that includes an aperture and chamber for projecting or amplifying a voice or sound.

It is another object of the invention to provide an applause enhancing apparatus and method that includes an aperture and chamber for aiming or directing a voice or sound.

It is another object of the invention to provide an applause enhancing apparatus that may be removably, or fixedly attached to a pompon.

It is a further object of the invention to provide a container having an identifying mark viewable from a first perspective, and a second, hidden mark being viewable from a second perspective.

It is a still further object of the invention to provide an applause enhancing apparatus having an identifying mark viewable from a first perspective, and a second, hidden mark being viewable from a second perspective.

It is another object of the invention to provide an applause enhancing apparatus that is stackable.

It is another object of the invention to provide an applause enhancing apparatus and method that includes a means to prevent the user from pinching a body part between the sections of the apparatus.

It is another object of the invention to provide an applause enhancing apparatus that is disposable.

It is another object of the invention to provide an applause enhancing apparatus and method that is a beverage of food container with a sealed, liquid-tight bottom.

It is another object of the invention to provide an applause enhancing apparatus and method that is a beverage of food container with an openable bottom.

It is another object of the invention to provide an applause enhancing apparatus and method that is a food or beverage container and a megaphone.

It is another object of the invention to provide an applause enhancing apparatus and method that is a food or beverage container holder and a megaphone.

It is another object of the invention to provide an applause enhancing apparatus and method that is a food or beverage container and is insulated.

It is another object of the invention to provide an applause enhancing apparatus and method that is a food or beverage container holder and is insulated.

It is another object of the invention to provide an applause enhancing apparatus and method that reduces throat tissue irritation or damage associated with prolonged shouting.

It is another object of the invention to provide an applause enhancing apparatus having a means to maintain the apparatus sections together when an object or cup is inserted into the apparatus.

It is another object of the invention to provide an applause enhancing apparatus having a means to spread the apparatus sections apart when an object or cup is removed from the apparatus.

It is another object of the invention to provide a food or beverage container holder that can hold containers of different sizes and shapes.

For simplicity sake, the numbered components shown herein could be interchanged throughout the drawings, providing a variety of combinations of the described invention.

Other objects and benefits of this invention will become apparent from the description that follows hereinafter when read in conjunction with the drawing FIGS. that accompany it.

BRIEF DESCRIPTION OF THE SEVERAL VIEWS OF THE DRAWING

The present invention is illustrated by way of example and is not limited by the figures of the accompanying drawings, in that like references indicate similar elements and in that:

FIG. 23A illustrates a cross sectional side view of the present invention having a handle with a movable locking means; Locking means joins the sections together to hold a container, food, beverage or the like;

Figure 74:
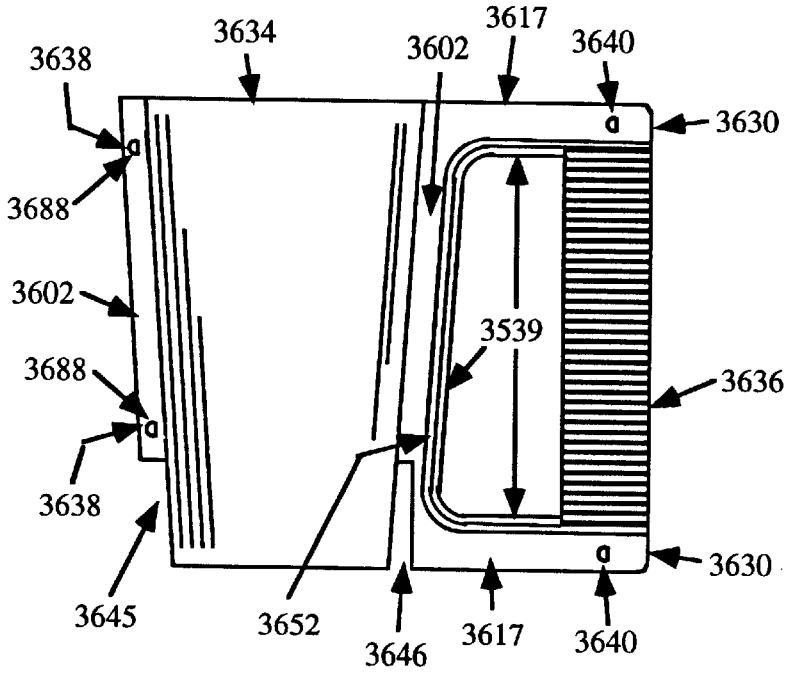
Figure 75:
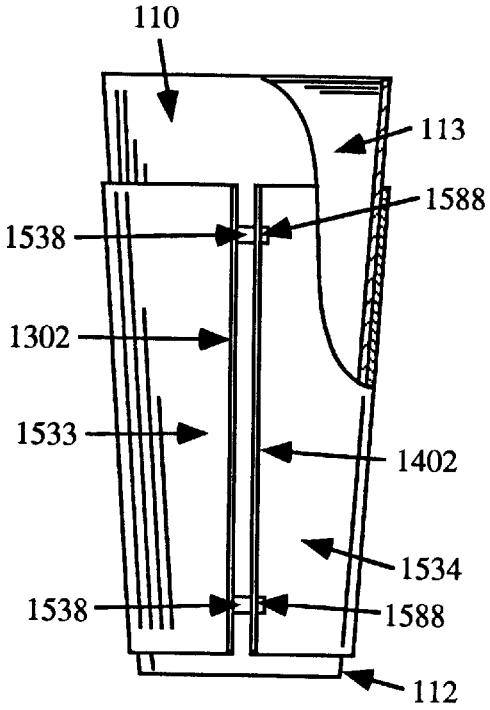
Figure 76:
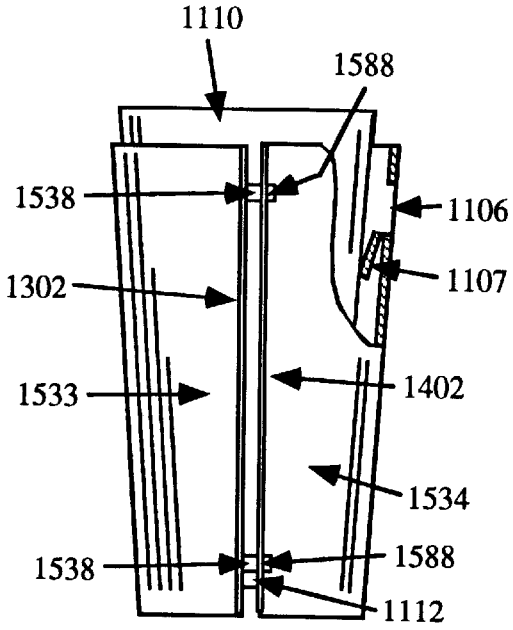

FIG. AA is a cross-sectional view of the applause enhancing apparatus of the present invention comprising a plurality of adjacent rails that include a guard, or anti-pinching means and a void, or space, to keep the rails separated and from binding when the apparatus is assembled and used;

FIG. 74 is a full side view of the applause enhancing apparatus of the present invention having a slot allowing the lower portion of the apparatus to be placed in a separate holder;

FIG. 75 is a full front view of the applause enhancing apparatus of the present invention having a self-adjusting means for accommodating containers of various sizes and shapes; and FIG. 76 is a full front view of the applause enhancing apparatus of the present invention having a selectively adjustable means for accommodating containers of various sizes and shapes.

DETAILED DESCRIPTION OF THE INVENTION

An apparatus and method for creating an audible sound is described. In the following description, numerous specific details are set forth, such as material types, dimensions, processes, etc., in order to provide a through understanding of the present invention. However, it will be obvious to one of ordinary skill in the art that the invention may be practiced without these specific details.

In other instances, well-known structures and processing steps have not been shown in particular detail in order to avoid unnecessarily obscuring the present invention. Additionally, it should be noted that this discussion will focus primarily on creating an audible sound to enhance an applause or boo. It should be understood, however, that such focus is for illustrative purposes only. The present invention is not limited to enhancing an applause nor is it limited to a container.

The applause enhancing apparatus, referred to as 14, 20, 33 and 34, 41, 49 and 95, 53, 63 and 64, 73 and 74, 83 and 84, 94, 99, 100, 114, 120, 126, 133 and 134, 140, 150 and 160, 173, 180 and 190, 220, 234, 306 and 310, 320, 333, 334, 433 and 434, 533 and 534, 1533 and 1534, 2534, 3634, and 4634 throughout this application, may be manufactured with, but not limited to, individually, or in combination, foam, plastic resin, metal, cellulose, wood, a composite material or the like and can be molded, formed, pressed or machined.

The present invention provides a simple apparatus that requires minimal effort to generate a noise or applause, regardless of the weather conditions, and allows an audience to maintain the sound level of an applause or boo throughout the performance, even allowing the spectator or audience to increase the applause sound level intensity, if so desired.

The present invention also allows spectators of different physical abilities to create a similar or comparable applause or noise level. Spectators with physical disabilities may have difficulty clapping their hands together, but would be able to generate an applause by grasping a handle of the present invention with one hand and striking it on their body, or some other readily accessible object, such as a stadium seat or railing. Small children will also be able to generate an applause or boo at a comparable noise level as an adult fan or spectator.

The present applause enhancing invention may directly hold the food or beverage, but it may be preferable for the present applause enhancer to hold a food or beverage container, eliminating any concerns about contamination that may be deposited on the inside of the prior art megaphone cups. The present invention also provides a low-cost, disposable megaphone cup, in that a beverage is served and consumed in the usual manner, and then the bottom of the megaphone cup is opened to create a megaphone. The openable bottom may remain attached or be removed from the megaphone cup.

The present invention includes a number of embodiments related to an applause enhancing device including a simple, one-piece device, shown in FIGS. 3–10, whereby a separate component is combined with an existing container. The user moves the device from a first biased position, where the components may be contacting each other, to a second non-contacting position, movement indicated by a large arrow throughout this application, here labeled "M" in FIG. 4, where the user then releases the applause generating apparatus to return to the first position where the one component strikes the other when they make contact resulting in an audible sound.

Figure 1:
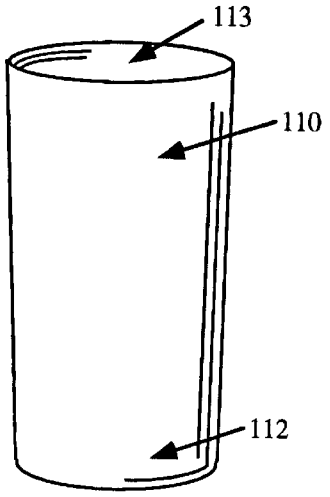
FIG. 1 PRIOR ART
FIG. 1 illustrates a prior art container.
Figure 2:
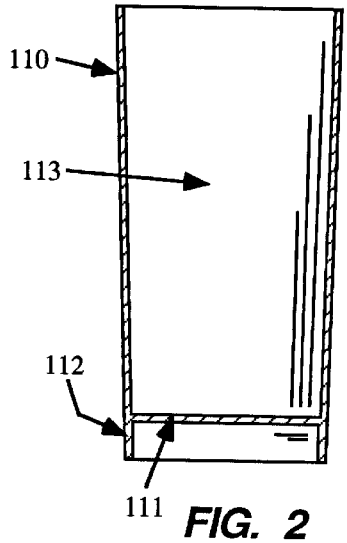
FIG. 2 PRIOR ART
FIG. 2 shows a cross sectional view of the prior art container of FIG. 1.
Figure 3:
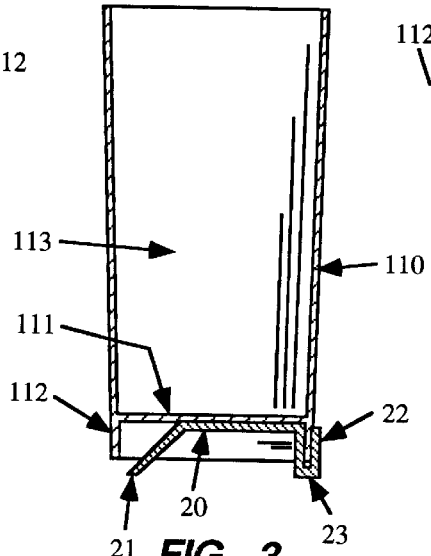
FIG. 3 illustrates a cross sectional view of a container with an applause enhancing apparatus in a first contacting position attached to the base of the container.

Referring to FIG. 3, a cross sectional side view of a container 110 is shown having a chamber or cavity 113 connected to the open top or mouth of the container. A sound creating apparatus 20 of the present invention is removably attached to the base 112 of container 110 by a gripping means 22 and protrusion creating a slot or channel 24 at the proximal end and a protrusion 21 at the distal end. Sound creating apparatus 20 is shown in a first contacting position relative to the bottom 111 of container 110. Applause enhancing apparatus 20 may include an identifying mark, indicia, logo or the like that can be attached as a label or manufactured as an integral part of the apparatus. The applause enhancing apparatus may also be integrally manufactured with a container.

Figure 4:
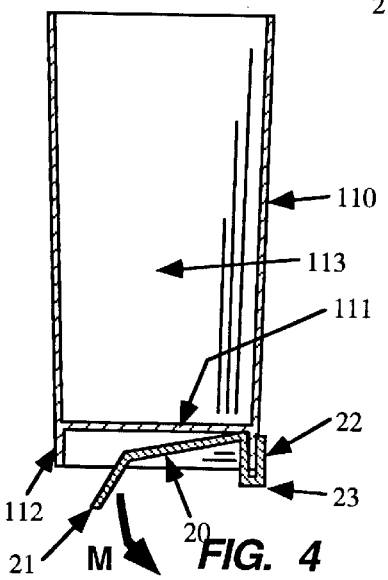
FIG. 4 illustrates the apparatus of FIG. 3 with an applause enhancing apparatus in a second position.

FIG. 4 is a cross sectional side view of the present invention comprising a container and applause enhancing apparatus of FIG. 3 showing an applause enhancing apparatus 20 in a second, non-contacting position relative to the bottom 111 of container 110. A resilient biasing force is created when the applause enhancing apparatus 20 is flexed away from the first contacting position.

Figure 5:
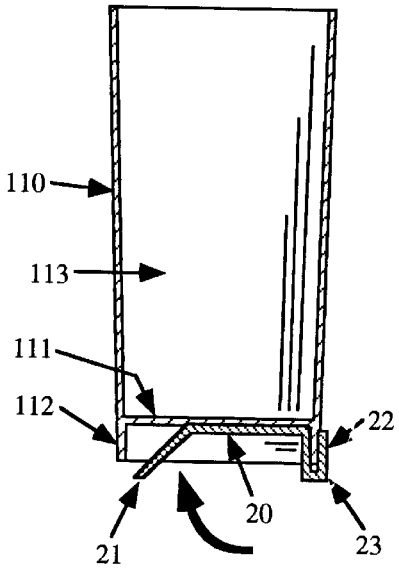
FIG. 5 illustrates the apparatus of FIG. 4 with the applause enhancing apparatus released and striking the base of a container, creating an audible sound.

FIG. 5 shows a cross sectional view of the container and applause enhancing apparatus 20 of FIG. 4 with the released applause enhancing component 20 striking the bottom 111 of container 110 and creating an audible sound.

Figure 6:
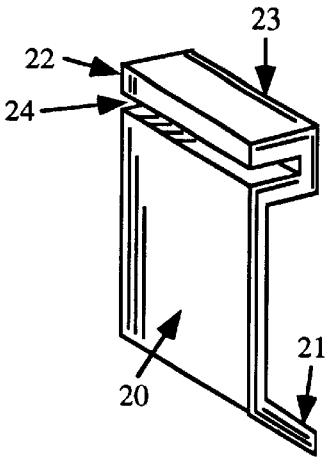
FIG. 6 shows a full view of one embodiment of the present invention that can be attached to a container to generate an audible sound.

FIG. 6 is a full side view of the present invention comprising an applause enhancing apparatus 20 being selectively attachable to a container, shown in FIGS. 3–5, having a protrusion 21 at the distal end, a gripping means or projection 22, an outer clip 23 and a slot 24. The applause enhancing apparatus 20 may include an identifying mark or the like that may be at least one color or comprise a logo, indicia or the like.

Figure 7:
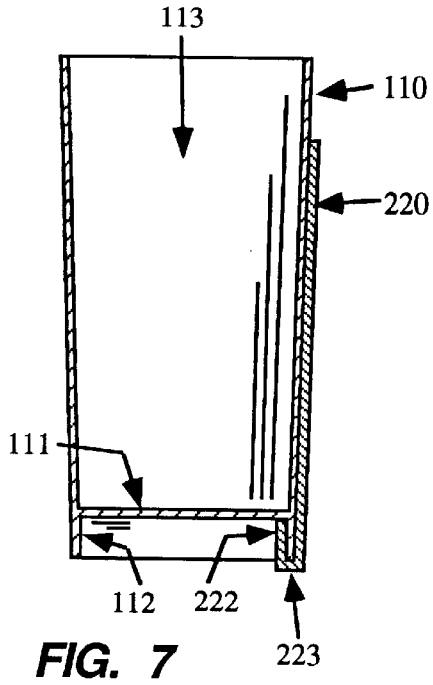
FIG. 7 shows a cross sectional view of another embodiment of the applause enhancing apparatus in a first contacting position engaging the side of a container.
Figure 21A:
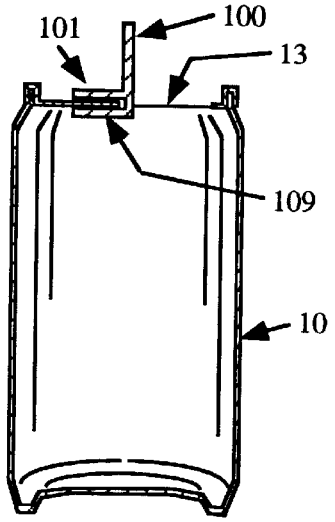
FIG. 21A illustrates a cross sectional side view of an applause enhancing apparatus in a first contacting position, attached to an open container.
Figure 21B:
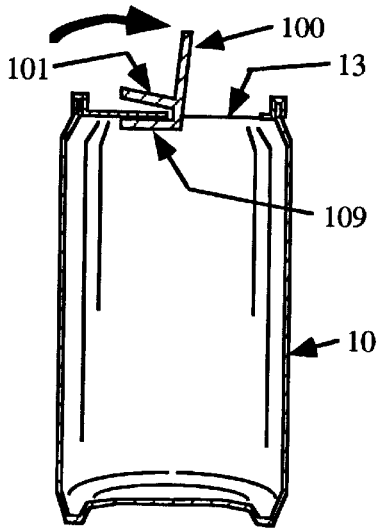
FIG. 21B illustrates a cross sectional side view of the apparatus of FIG. 21A in a second, non-contacting position, attached to an open container.
Figure 21C:
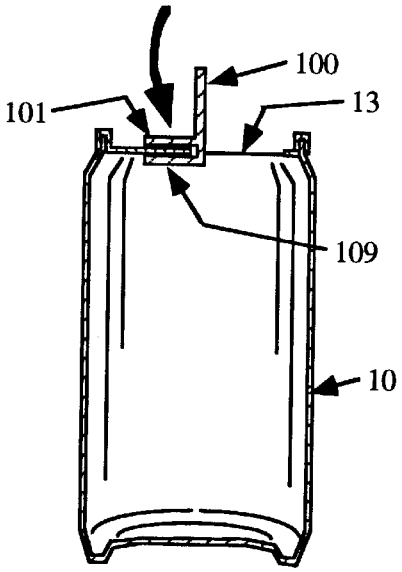
FIG. 21C illustrates a cross sectional side view of the apparatus of FIG. 21B in a third contacting position, striking the container, creating an audible sound.

FIG. 7 is a cross sectional side view of another embodiment of the present invention comprising an applause enhancing apparatus 220 contacting the side of container 110. Container 110 having a hollow cavity or chamber 113, a bottom wall 111 and a base 112. Applause enhancing apparatus 220 having a clip 223 and gripping means 222 for selectively attaching applause enhancing apparatus 220 to container 110. Applause enhancing apparatus 220 may include an identifying mark, indicia, logo or the like that can be attached as a label or manufactured as an integral part of the apparatus. Applause enhancing apparatus 220 may also be attached by inserting the attaching end inside the pop top opening of a container or can as shown in FIGS. 21A–21C.

Figure 8A:
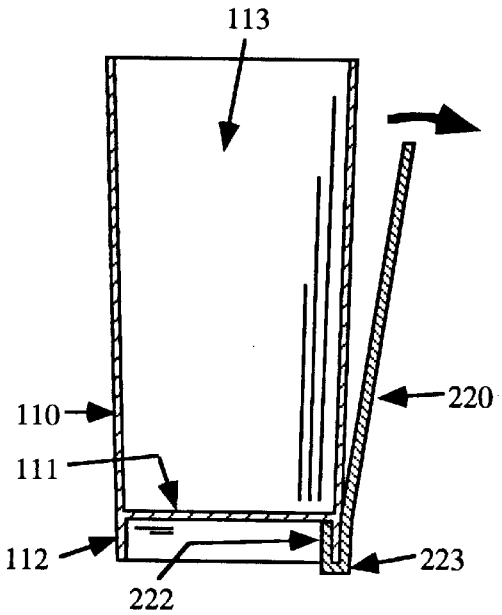
FIG. 8A illustrates the apparatus of FIG. 7 with an applause enhancing apparatus in a second, non-contacting position.

FIG. 8A is a cross sectional side view of the container and applause enhancing apparatus shown in FIG. 7 with the applause enhancing apparatus 220 shown in a tensioned, non-contacting position relative to the side of the container 110. Applause enhancing apparatus can be selectively released from a tensioned, non-contacting position to strike the side wall of container 110 creating an audible sound.

Figure 8B:
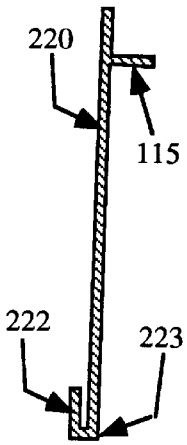
FIG. 8B shows a cross sectional view of the apparatus of FIG. 8A having a finger post or projection.

FIG. 8B is a cross sectional side view of the applause enhancing apparatus 220 of FIG. 8A having a clip 223, a gripping means 222 for selectively attaching applause enhancing apparatus 220 to container and a projection or finger post 115.

Figure 9:
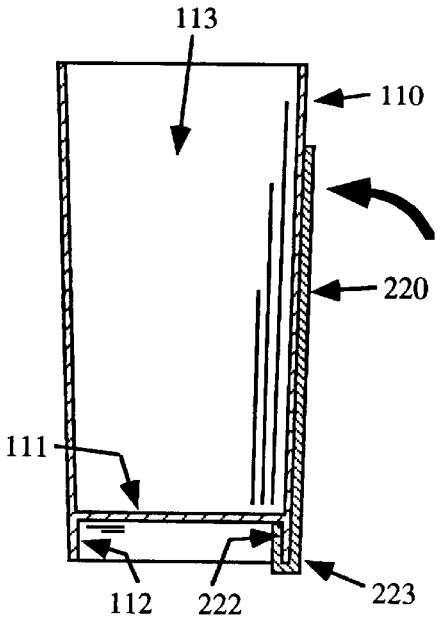
FIG. 9 illustrates the apparatus of FIG. 8A with the applause enhancing apparatus released and striking the base of the container, creating an audible sound.

FIG. 9 is a cross sectional side view of a container and applause enhancing apparatus shown in FIGS. 7 and 8A with applause enhancing apparatus 220 shown striking the side of container 110 creating an audible sound or noise.

Figure 10:
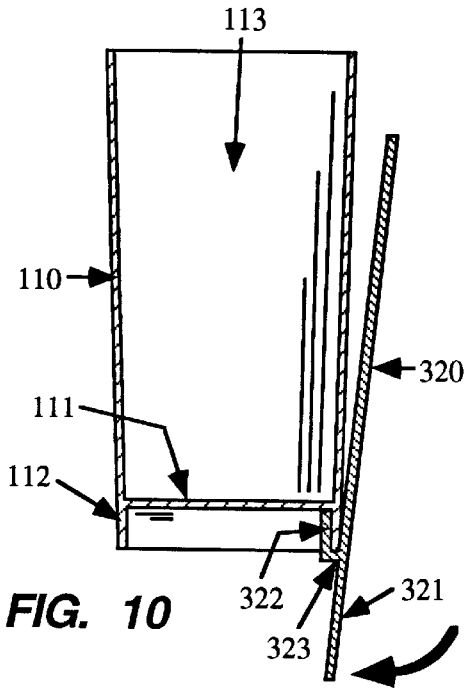
FIG. 10 shows a cross sectional view of the present invention with an applause enhancing apparatus in a non-contacting position and having at least one projection.

FIG. 10 is a cross sectional side view of the present invention comprising another embodiment of an applause enhancing apparatus 320 that contacts the side of container 110 having a gripping means 322, a connecting section 323 and a protrusion 321 for selectively moving and releasing applause enhancing apparatus 320. An audible sound is created when applause enhancing apparatus 320 is moved to a non-contacting position, and then released to strike the side wall of container 110.

Another two piece applause enhancer is shown in FIGS. 11A–16, where each section is grippable by the hands and can be separated and brought back together with a striking motion to create an audible sound. A cavity or chamber may be included to enhance a sound or noise. A noise may also be created by adding a whistle to the present invention as shown in FIG. 11E. The chamber shape may create a directional sound, depending on the shape, or configuration of the chamber, that may be conical, frusto-conical, cylindrical, round, elliptical or geometric. Spectators normally place their hands around their mouth to aim their voice in a specific direction. The sound waves reflect off the cupped hands and move in a more specific direction. The applause enhancing apparatus of the present invention may be manufactured from virgin or recycled plastic, cellulose products, metal, composites, or any other material suitable for creating the device. Many manufacturing processes can be utilized in the manufacture of the present invention, including, but not limited to, injection molding, machining, thermoforming, pressing, laminating, blow molding, rotomolding or the like.

Figure 11A:
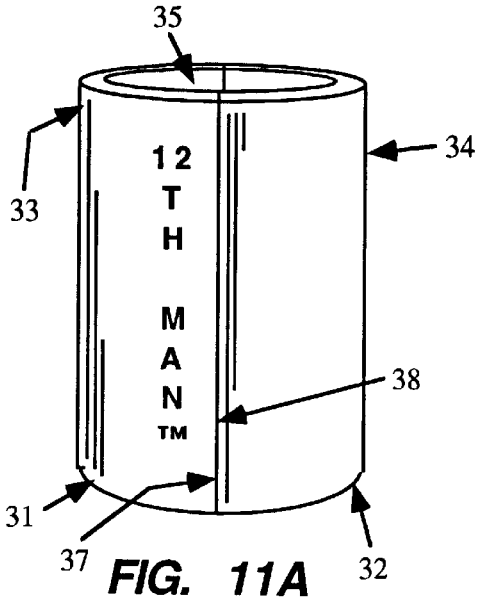
FIG. 11A illustrates another embodiment of the present invention that is used to hold a beverage or food container and has one open end and one closed end.

FIG. 11A is a full side view of the present invention comprising an applause enhancing apparatus with a plurality of corresponding sections 33 and 34, each having a base 31 and 32 respectively, and a joining, or contacting section 37 and 38. The applause enhancing apparatus 33 and 34 create a container with an open end, a closed bottom and a chamber 35 when they are joined together.

Figure 11B:
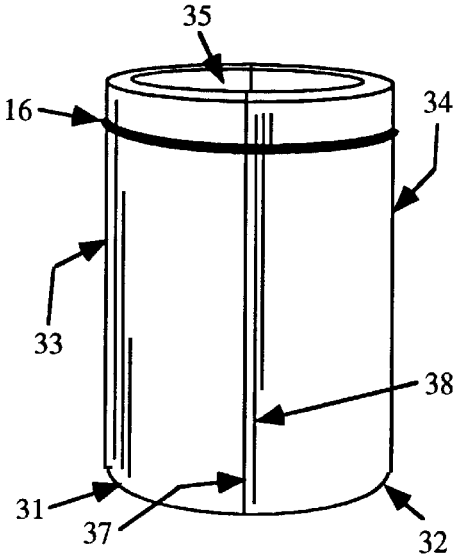
FIG. 11B illustrates the apparatus of FIG. 11A having an annular component to maintain the sections of the apparatus adjacent to each other.

FIG. 11B is a full side view of the present invention having a simple elastomeric or rigid annular component 16 placed around the applause enhancing apparatus to join the sections 33 and 34 together so a container may be placed within the applause enhancing apparatus. Annular component 16 may be manufactured integrally with the applause enhancing apparatus, or be a separate component. An insulative material may be used to manufacture the applause enhancing apparatus 33 and 34.

Figure 11C:
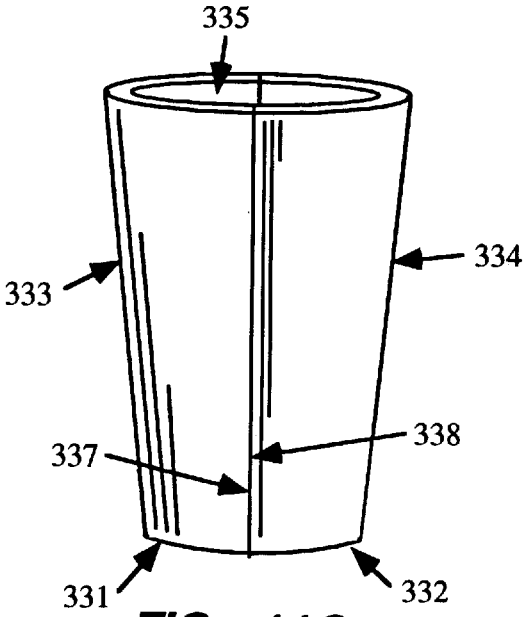
FIG. 11C shows a full view of another embodiment of the present invention having a conical shape.

FIG. 11C is a full side view of the present invention having a conical shape, comprising a plurality of corresponding sections 333 and 334, each having a base 331 and 332 respectively, and a joining, or contacting section 337 and 338. The applause enhancing apparatus 333 and 334 create a container with an open end, a closed bottom and a chamber 335 when they are joined together.

Figure 11D:
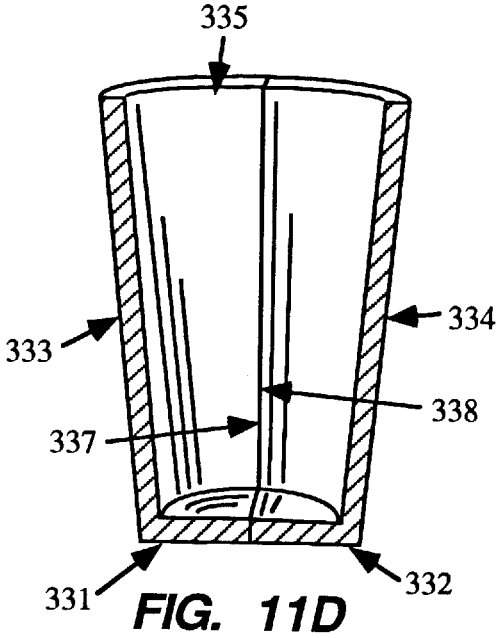
FIG. 11D shows a cross sectional view of the apparatus of FIG. 11C.

FIG. 11D is a cross sectional side view of FIG. 11C having a conical shape, comprising a plurality of corresponding sections 333 and 334, each having a base 331 and 332 respectively, and a joining, or contacting section 337 and 338. The applause enhancing apparatus 333 and 334 create a container with an open end, a closed bottom and a chamber 335 when they are joined together.

Figure 11E:
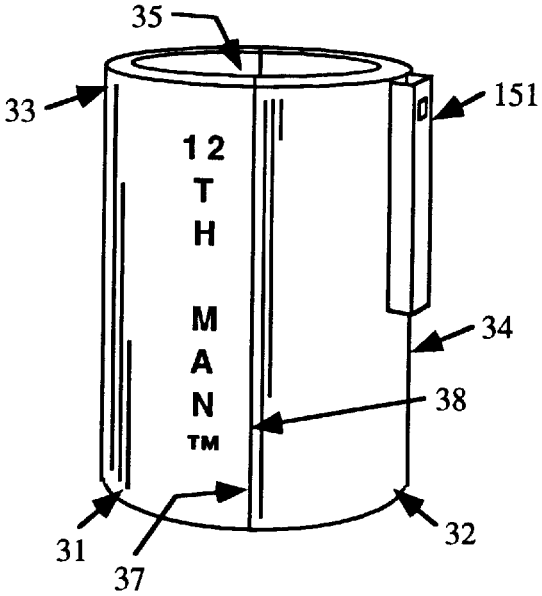
FIG. 11E illustrates a full view of the present invention including a whistle.

FIG. 11E is a full view of the applause enhancing apparatus of FIG. 11A showing at least one section including a chamber or aperture 151 that generates a whistling sound when air is propelled through said aperture or chamber. The whistle may be included in all of the applause enhancing apparatus described herein.

Figure 12A:
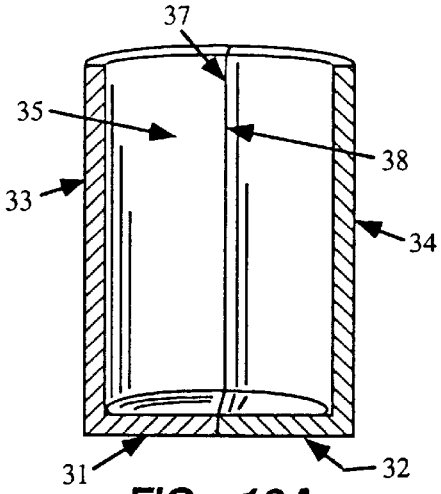
FIG. 12A shows a cross sectional side view of the applause enhancing apparatus of FIG. 11A.

FIG. 12A is a cross sectional side view of the applause enhancing apparatus of FIG. 11A comprising sections 33 and 34 that are joined together at intersecting areas 37 and 38 respectively. Applause enhancing apparatus 33 and 34 may include an identifying mark, indicia, logo or the like that can be attached as a label or manufactured as an integral part of the apparatus. The base sections 31 and 32 respectively, are shown but are not necessary to create a noise or audible sound with the applause enhancing apparatus 33 and 34.

Figure 12B:
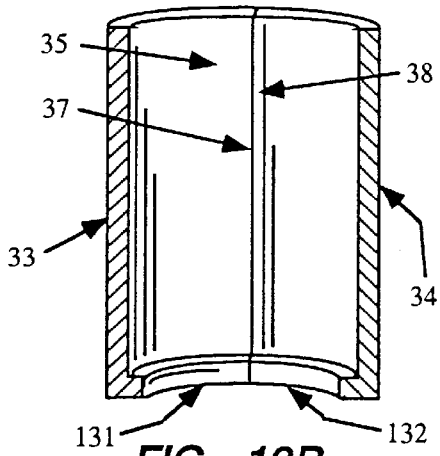
FIG. 12B shows a cross sectional side view of the apparatus of FIG. 12A having a base with an aperture.

FIG. 12B is a cross sectional side view of the present invention having sections 33 and 34, intersecting areas 37 and 38 respectively, creating chamber 35 when joined together, and a corresponding base sections 131 and 132 creating an aperture sufficient in size to talk or create a sound through, whereby the applause enhancing apparatus 33 and 34 may project or amplify a voice or sound like a megaphone.

Figure 13A:
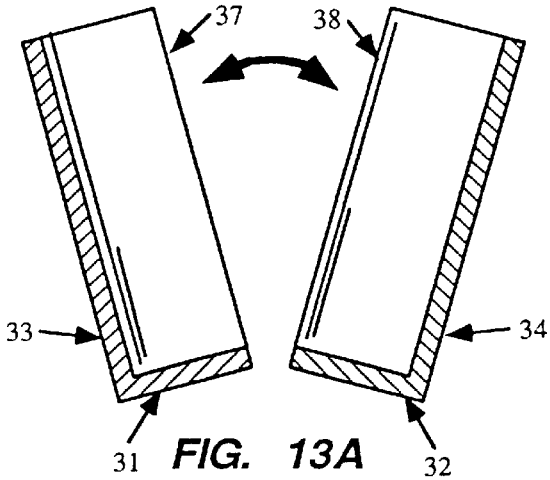
FIG. 13A illustrates a cross sectional side view of the applause enhancing apparatus of FIG. 12 with the sections separated.

FIG. 13A is a cross sectional side view of the applause enhancing apparatus of FIGS. 11A and 12A showing corresponding sections 33 and 34 separated from each other. The sections 33 and 34 may be moved together, striking each other, creating an audible sound, as shown in FIG. 14.

Figure 13B:
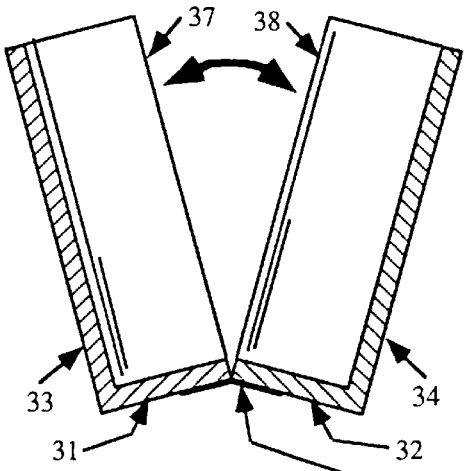
FIG. 13B is a cross sectional view of the present invention having a hinge section at the base of the apparatus.

The base or bottom of the applause enhancing device may also include a hinge section as shown in FIG. 13B, so the sections remain oriented and aligned between a first closed position, a second open position and a third closed position. This embodiment may also be attached to a post or pompon, so when the post or pompon is shaken a noise is emitted.

FIG. 13B is a cross sectional side view of the apparatus of FIG. 13A being joined together by a hinge 270, allowing the sections 33 and 34 to be selectively moved from a contacting to non-contacting position, or from a non-contacting to a contacting position. A hinge means may be longitudinally oriented on the edge of the side of the applause enhancing apparatus connecting the sides of sections 33 and 34 at either intersecting section 37 or 38.

Figure 14:
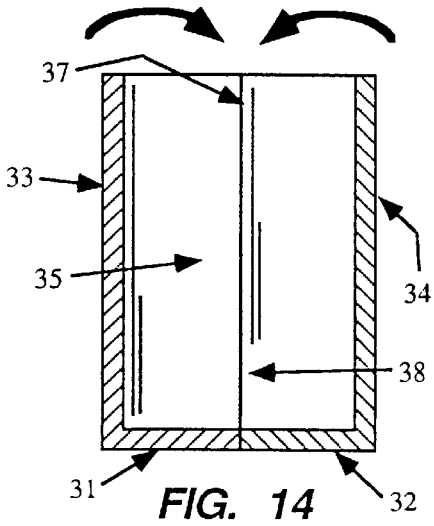
FIG. 14 illustrates a cross sectional side view of the applause enhancing apparatus of FIG. 12A with the sections striking each other creating an audible sound.

FIG. 14 is a cross sectional side view of the applause enhancing apparatus of FIGS. 11A and 13A showing the corresponding sections 33 and 34 striking each other at intersecting sections 37 and 38 respectively, creating an audible sound. Chamber 35 is created when sections 33 and 34 are contacting at intersecting sections 37 and 38.

Figure 15:
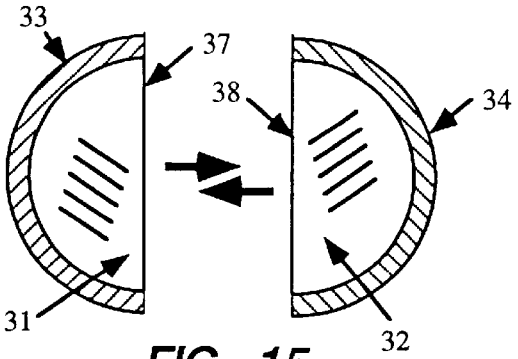
FIG. 15 illustrates a cross sectional top view of FIG. 13A where the sections are separated from each other, and can be moved together to create an audible sound.

FIG. 15 is a cross sectional top view of the applause enhancing apparatus of FIG. 13A showing the corresponding sections 33 and 34 separated from each other.

Figure 16:
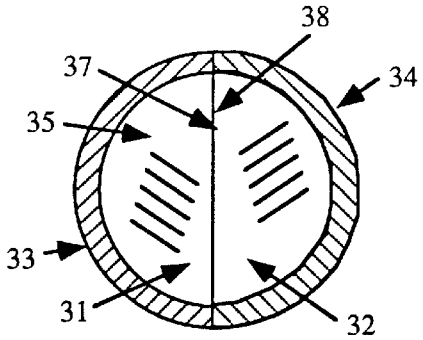
FIG. 16 illustrates a cross sectional top view of FIG. 14 where the sections are contacting each other to hold a container or create an audible sound.

FIG. 16 is a cross sectional top view of the applause enhancing apparatus of FIG. 14 showing the corresponding sections 33 and 34 striking each other at intersecting sections 37 and 38 respectively, creating an audible sound.

A two piece applause enhancer is shown in FIGS. 18A–20C and 22, where sections are joined by a hinge so the sections remain oriented and aligned between a first contacting position, a second separated position, and a third striking, or contacting position. The applause enhancer of the present invention may also include a section that can be used as a handle for holding a container, creating a sound, or for enhancing an applause. A means for joining the sections together may include an annular component that holds the handles together so a beverage container can be placed in the applause enhancing device shown in FIGS. 19B and 19C.

Figure 18B:
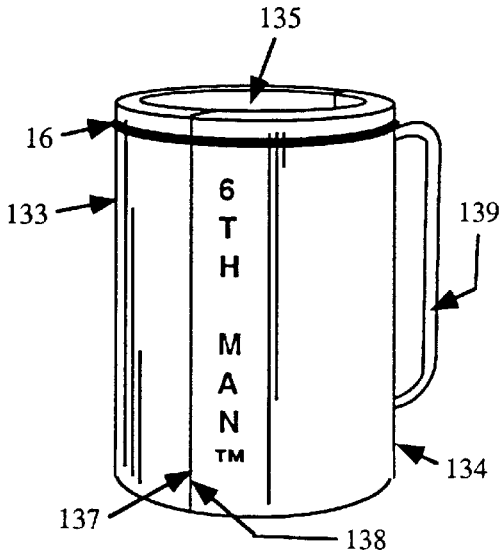
FIG. 18B illustrates a full view of the apparatus of FIG. 18A having an annular component to maintain the sections of the apparatus adjacent to each other.
Figure 18A:
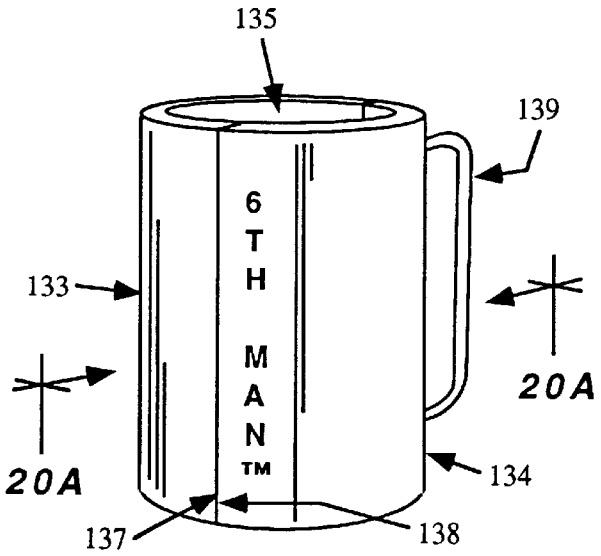
FIG. 18A is a full view of one embodiment of the present invention with a plurality of separably joined sections and a handle.
Figure 17:
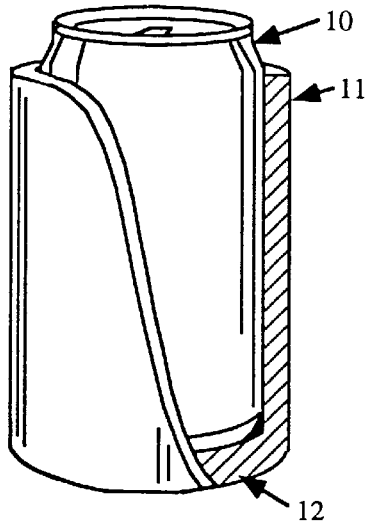
FIG. 17 PRIOR ART
FIG. 17 is a cross sectional view of a prior art insulated beverage container holder with a prior art beverage container within the holder.

FIG. 18A is a full side view of the present invention comprising an applause enhancing apparatus with a handle having a plurality of corresponding sections 133 and 134, interfacing sections 137 and 138 and a handle 139. Each section 133 and 134 may include an individual handle. The applause enhancing apparatus 133 and 134 create a container with a chamber 135 when they are joined together. An insulative material may be used to manufacture the applause enhancing apparatus 133 and 134. Applause enhancing apparatus 133 and 134 or handle 139 may include an identifying mark, indicia, logo or the like that can be attached as a label or manufactured as an integral part of the apparatus.

FIG. 18B is a full side view of the apparatus of FIG. 18A including an elastomeric or rigid annular component 16 that may be placed around the applause enhancing apparatus to join the sections 133 and 134 together so a container may be placed within the applause enhancing apparatus. Annular component 16 may be manufactured integrally with the applause enhancing apparatus, or be a separate component. An insulative material may be used to manufacture the applause enhancing apparatus 133 and 134.

Figure 19A:
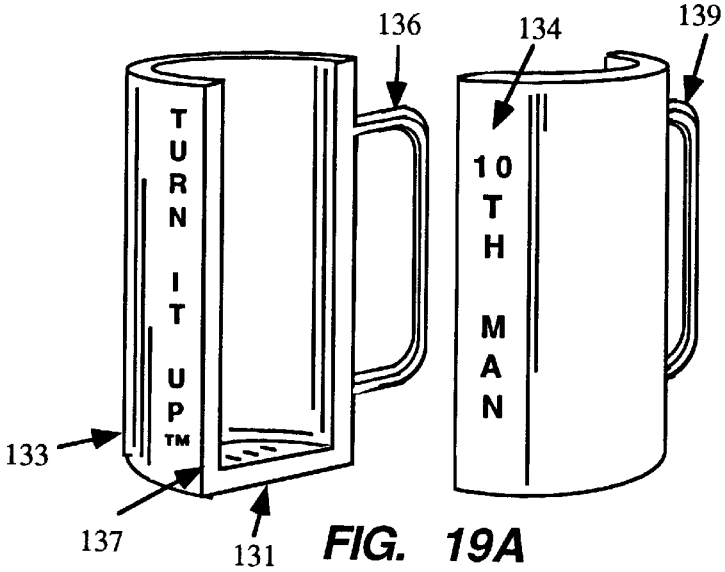
FIG. 19A shows a full view of the apparatus of FIG. 18A with a plurality of sections separated and each having a handle.

FIG. 19A is a full side view of the present invention comprising an applause enhancing apparatus showing corresponding sections 133 and 134 separated and each section having an individual handle 136 and 139 respectively. Section 133 having a handle 136, a bottom 131 and a face 137 that intersects with a corresponding section on adjacent surface of section 134.

Figure 19B:
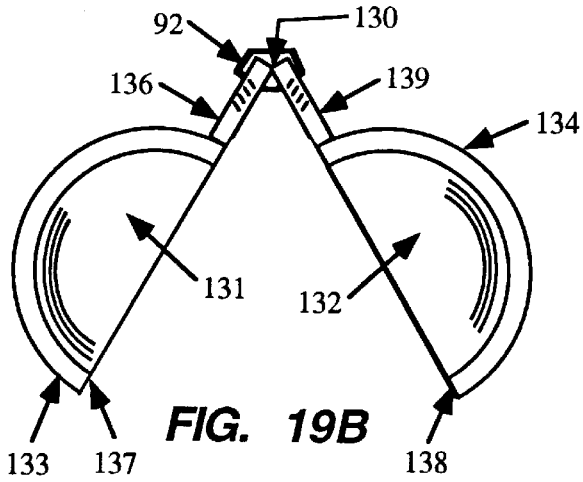
FIG. 19B illustrates a full top view of the present invention having an annular member that creates a hinge on the handles, allowing the sections to separate or open, and maintains the sections in an aligned or oriented position, relative to each other.

FIG. 19B is a full top view of FIG. 19A having corresponding sections 133 and 134 separated and each section having an individual handle 136 and 139 respectively, and interfacing sections 137 and 138 respectively, bottoms 131 and 132 respectively, a hinge area 130, and a movable member 92 positioned away from sections 133 and 134 on handles 136 and 139. Position of movable member 92 allows sections 133 and 134 to move from a first contacting position to a second, noncontacting position, and back to a third, contacting position, allowing sections 133 and 134 to strike each other creating an audible sound. Hinge 130 is longitudinally oriented on the edge of handles 136 and 139.

Figure 19C:
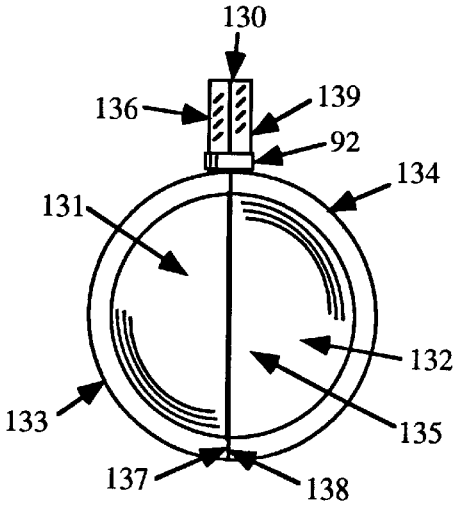
FIG. 19C illustrates a full top view of the apparatus of FIG. 19B having an annular member on the handles that biases the sections together, allowing the sections to remain in contact or closed, and maintains the sections in an aligned or oriented position, relative to each other.

As the movable member 92 is moved toward the handles/bodies interface, the sections 133 and 134 will remain joined together as shown in FIG. 19C. As the movable member 92 is moved to the axle of the handles 136 and 139 that is parallel to the apparatus 133 and 134, a hinge 130 is created and the sections 133 and 134 may part or open.

FIG. 19C is a full top view of the apparatus of FIG. 19A with movable member 92 positioned adjacent to the bodies of sections 133 and 134, biasing sections 133 and 134 to remain in a contacting, or closed position, allowing a food or beverage container to be placed within apparatus 133 and 134.

Figure 20A:
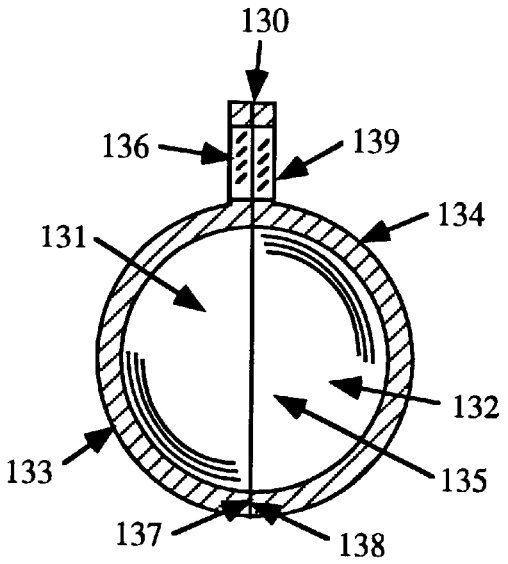
FIG. 20A illustrates a top cross sectional view of the applause enhancing apparatus of the present invention in a first contacting position with the two sections closed together, and connected at a hinge.

FIG. 20A is a full top view of the apparatus of FIG. 18A shown in axis 20A—20A being in a first contacting, or closed position, having a plurality of corresponding sections 133 and 134, interfacing sections 137 and 138 respectively, bottoms 131 and 132 respectively, and handles 136 and 139 respectively, joined at hinge 130. Food or a food or beverage container may be placed within cavity 135 that is created when sections 133 and 134 are closed or joined together. Hinge 130 is longitudinally oriented on the edge of handles 136 and 139.

Figure 20B:
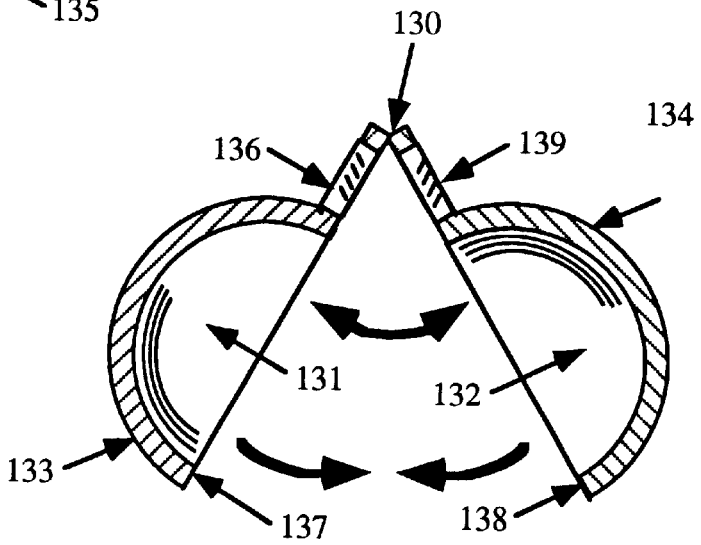
FIG. 20B illustrates a top cross sectional view of the apparatus of FIG. 20A being moved to a second position with the two sections separated in a non-contacting position, and connected at a hinge.

FIG. 20B is a cross sectional top view of the applause enhancing apparatus of FIG. 20A showing the corresponding sections 133 and 134 in a non-contacting, opened position, yet joined by hinge section 130, with each section 133 and 134 having a handle 136 and 139 respectively. Hinge 130 may be an integral living hinge or a separate component having a hinging means. As apparatus 133 and 134 is moved back and forth, sections 133 and 134 open and close, striking together at intersecting sections 137 and 138 respectively on the closing stroke, creating an audible sound.

Figure 20C:
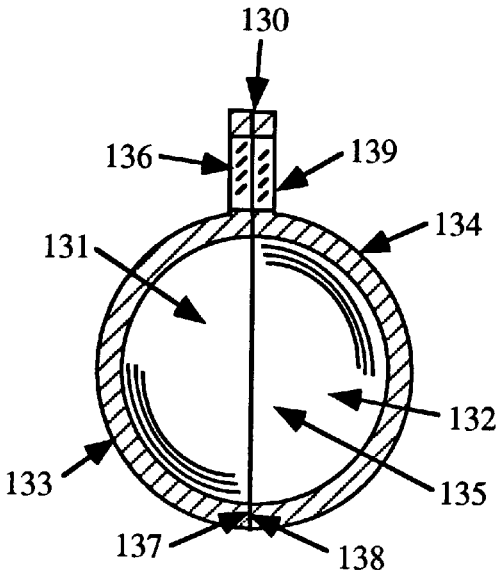
FIG. 20C illustrates a top cross sectional view of the apparatus of FIG. 20B in a third contacting position, striking each other, creating an audible sound with the two sections closed, and connected at a hinge.

FIG. 20C is a full top view of the apparatus of FIG. 20B shown in a third, contacting position with sections 133 and 134 striking each other at intersecting sections 137 and 138 respectively, creating an audible sound.

A simple one-piece applause enhancing apparatus is shown in FIGS. 21A–21C, being removably attachable to a food or beverage container, where the applause enhancing apparatus is moved from a first biased position to a second non-contacting position, and selectively released to a third contacting position creating an audible sound when the applause enhancing apparatus strikes the container.

FIG. 21A is a cross sectional side view of the applause enhancing apparatus of the present invention residing in the opening 13 of a container 10, shown in a first position, having an inner projection 109, an outer projection 101, that is selectively movable from a first contacting position, to a second non-contacting position to a third contacting position, creating an audible sound by means of lever or projection 100 contacting container 10.

FIG. 21B is a cross sectional side view of the apparatus of FIG. 21A residing in the opening 13 of a container 10, shown in a second, non-contacting position, having an inner projection 109, an outer projection 101, that is selectively moved from a first contacting position, to a second non-contacting position.

FIG. 21C is a cross sectional side view of the apparatus of FIG. 21A residing in the opening 13 of a container 10, shown in a third, striking position, having an inner projection 109, an outer projection 101, that is selectively released from a second, non-contacting position, creating an audible sound.

Figure 22:
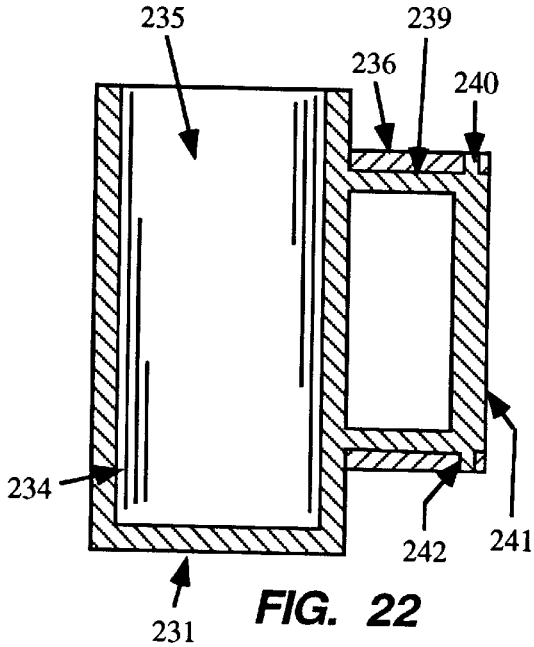
FIG. 22 illustrates a cross sectional side view of the present invention having a plurality of sections and a hinged handle.

FIG. 22 is a cross sectional side view of another embodiment of the present invention comprising an applause enhancing apparatus with the handles 236 and 239 being hingedly attached together by at least one protrusion or pin 240 that fits into a corresponding slot or recess 242. Applause enhancing apparatus may be held in one hand by handle 241 and moved back and forth causing corresponding sections 233 (not shown here) and 234 to separate and strike together allowing applause enhancing apparatus to create an audible sound by using only one hand.

Figure 23A:
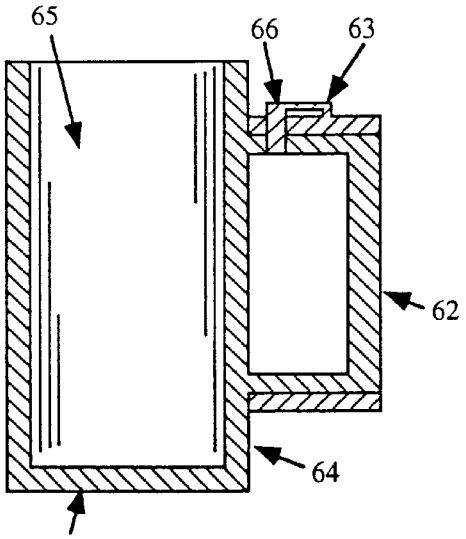
Figure 25:
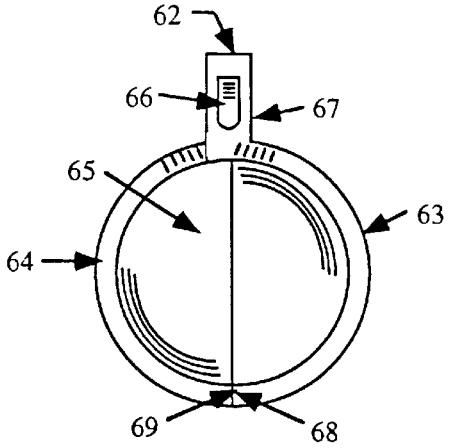
FIG. 25 illustrates a full top view of the present invention with a locking means engaged, maintaining the sections together.
Figure 23B:
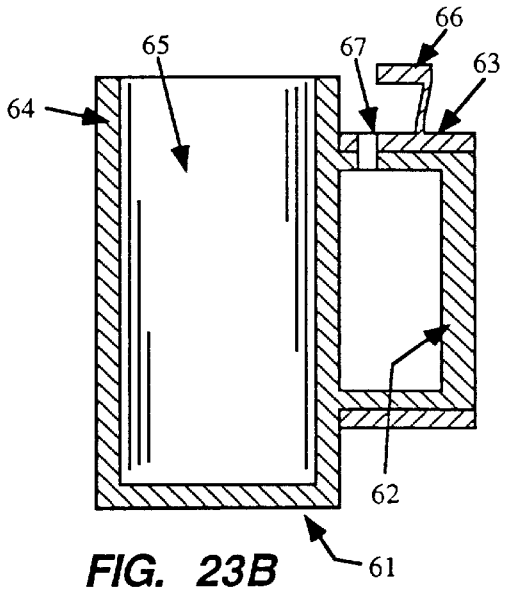
FIG. 23B illustrates the applause enhancing apparatus of FIG. 23A with the locking means removed from a locking position; The applause enhancing apparatus is now capable of being separated and joined together to create an audible sound.
Figure 36:
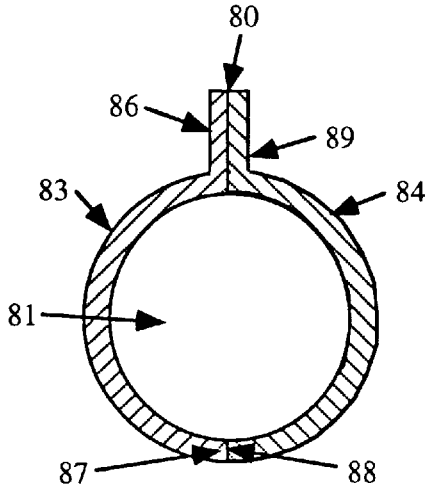
FIG. 36 is a top cross sectional view of an applause enhancing apparatus with an inner cavity with two open ends, a bottom aperture and without a bottom land or projection.
Figure 37:
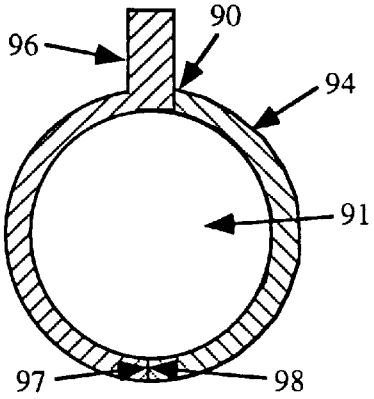
FIG. 37 is a top cross sectional view of an applause enhancing apparatus with an inner cavity with two open ends, a single handle, and a hinged body section.

Another joining means can be manufactured into the components themselves as shown in FIGS. 23A, 23B and 25. The applause enhancers described herein may also include a removable or attached pompon, that are normally used by cheerleaders. The bottom of the applause enhancing device may include at least one aperture whereby a voice can be projected through the applause enhancing device like a megaphone as shown in FIGS. 36–37, and in other embodiments in this application. Thus, the applause enhancing device can be incorporated into cheering routines.

FIG. 23A is a cross sectional side view of the present invention comprising an applause enhancing apparatus 64 having a chamber 65 a bottom 61, and a handle 62 that is selectively joined together by locking pin 66 that is connected to handle 62 at hinge 63. The applause enhancing apparatus comprises two sections (only one section 64 is shown here) that create a holder for a container. Locking the corresponding sections together maintains the sections adjacent to each other. A means to lock the sections together may be provided so when a container or object is inserted into the closed applause enhancing apparatus, the sections remain joined together, and when a container or object is removed, the sections are free to open. This may be accomplished by a projection or cam that is movable from a first unlocked position, to a second locked position.

FIG. 23B is a sectional side view of the applause enhancing apparatus of FIG. 23A having a the locking pin 66 removed from a locking position whereby the applause enhancing apparatus may be opened and closed, and used to create an audible sound.

A towel is also used to show spectator approval at events. Spectators hold the towel and spin it around like a propeller. The present invention also provides a noise making device that is attachable to spinning end of the towel, so when the towel is moved through the air, an audible sound is emitted. The noise emitting device may be permanently, or removably attached to the towel.

Another embodiment of a towel related applause enhancer may comprise an apparatus that is held by the hand with a towel attached. As the attached towel is spun or shaken, a noise is emitted by the apparatus.

Figure 24A:
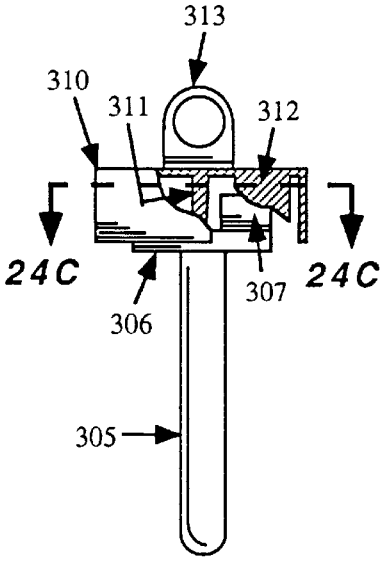
FIG. 24A is a cut away side view of an applause enhancing apparatus of the present invention that is used in conjunction with a towel.
Figure 24B:
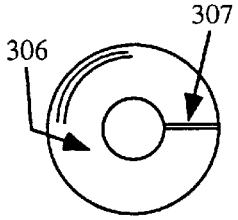
FIG. 24B is an full top view of the grippable component of the apparatus shown in FIG. 24A, having a projection or post
Figure 24C:
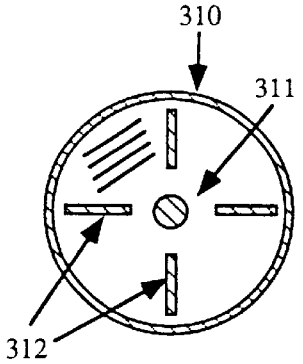
FIG. 24C is a cross sectional view of the towel holding component of the apparatus of FIG. 24A shown in axis 24C—24C, having a center post and a plurality of fins.

A simple two-piece applause enhancer that is used with a towel is shown in FIGS. 24A–24C, where a towel is removably attached to the apparatus and the user moves the apparatus in a circular motion, spinning the towel causing the fins of the apparatus to contact a fixed projection, creating an audible sound.

FIG. 24A is a cut away side view of an applause enhancing apparatus that may be used in conjunction with a towel, comprising a base 306 having a grippable post 305 and a fixed projection 307, being selectively attachable to a movable housing 310, that is concentrically located on base 306 by barbed axle or pin 311, housing 310 having an aperture or gripping means 313 to selectively attach a towel, and at least one flexible fin 312 that contacts with post 307 of base 306. The user places a towel partially through aperture 313 and moves apparatus and towel on a circular motion, causing towel to spin on apparatus, creating an audible sound when flexible fin 312 contacts post 307 of base 306. Thus, a spectator can create both a visual and audible sound effect at the same time.

FIG. 24B is a full top view of the grippable apparatus of FIG. 24A, having a base 306 and a fixed post 307.

FIG. 24C is a cross sectional view of the towel holding apparatus of FIG. 24A shown in axis 24C—24C, having a housing 310, a concentrically located pin 311, and a plurality of flexible fins 312.

FIG. 25 is a full top view of the applause enhancing apparatus of FIGS. 23A and 23B with the corresponding sections 63 and 64 contacting or striking each other at interfaces 69 and 68 respectively, creating an audible sound when struck together. Sections 63 and 64 are joined at handle 62. If locking pin 66 is in locking position, sections remain joined and ready to use as a container, food or beverage holder.

Figure 26:
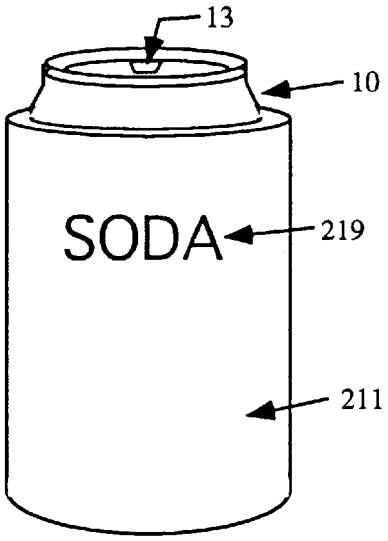
FIG. 26 PRIOR ART
FIG. 26 shows a full side view of a prior art beverage container and container holder with an indicia, message or advertisement being viewable from a first perspective.

Typically prior art food or beverage containers, or container holders, include an identifying mark, indicia, message or advertisement as shown in FIG. 26. The present invention may include at least one identifying mark, indicia, message or advertisement. Additionally, the present invention, shown in FIG. 27, may also include a plurality of marks, indicia, messages or advertisements whereby a first mark, indicia, message or advertisement is viewed in a normal fashion from a first perspective, with a second mark, indicia, message or advertisement being viewable only from a second perspective, revealing a "hidden" or second mark, indicia, message, or advertisement. The viewable and hidden marks may be directly placed on a food or beverage container. It is also note that the second, or "hidden" mark can be oriented 180° to the first mark, so the second mark is viewable when the user is consuming the food or beverage of the container, or shouting through the megaphone cup.

An indicia or message can be provided on the present invention, or a container or package, and may include at least one, or a plurality of messages where each can be viewed individually, depending on the viewing perspective, or in the case of a plurality, viewed together. The beverage or food holding applause enhancer may also include an insulating means to better maintain a desired beverage or food temperature. The insulating means also isolates the user from the hot or cold temperatures contained in the beverage or food. The applause enhancer may include a means for amplifying or projecting a voice or other audible sounds.

FIG. 26 is a full side view of a prior art beverage container 10 with a pop top opening 13 and holder 211 having an identifying mark 219. A second concealed mark is not viewable from this perspective.

Figure 27:
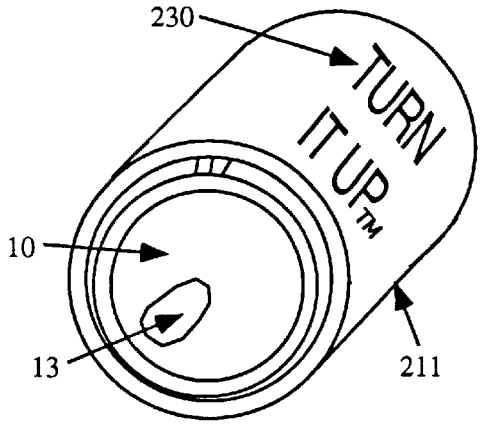
FIG. 27 shows a full side view of a beverage container of the present invention from a second perspective, revealing a "hidden" or second mark, indicia, message, or advertisement that is viewable from a second perspective.

FIG. 27 is a full view from a second perspective of the present invention comprising a beverage container 10 with a pop top opening 13 and holder 211 of FIG. 26 where a second "hidden" mark 230 or message is now viewable from this second perspective. The mark viewed from the first perspective 219 may also be viewable from a second perspective but is not shown viewable in this drawing. The container may include a means for having a plurality of messages on a label, container or package where only one message can be viewed at a time. This can be accomplished by holographic, refractive, layered, hidden imaging or the like.

A hidden mark or message may be used to identify a prize in a contest or sweepstakes. The hidden mark may also be included on any applause enhancing apparatus shown in this application.

A simple hand clapper is shown in FIGS. 28–31, where the user places a hand or fingers within an aperture or handle and strikes the apparatus against a bare or gloved hand, another hand clapper, or another object.

The applause enhancing apparatus of the present invention may also include a resilient strap or handle to maintain the applause enhancing apparatus adjacent to a hand or body part.

Figure 32:
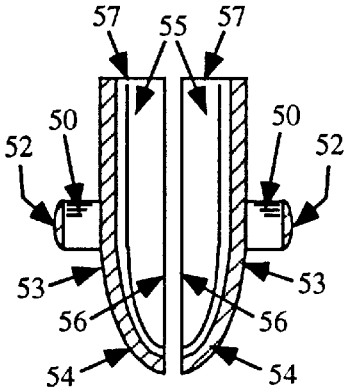
FIG. 32 is a cross sectional side view of a plurality of paddles that create a cavity, or sound chamber when the paddles are joined together.
Figure 33:
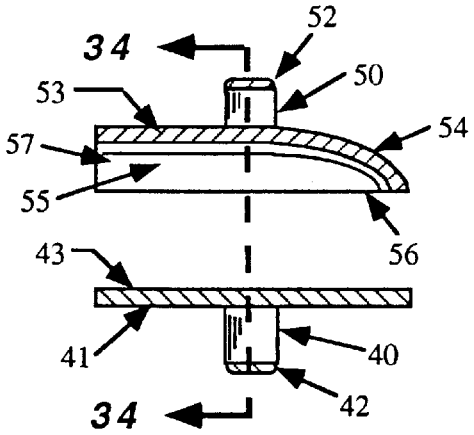
FIG. 33 is a cut away side view of the platform paddle of FIG. 30 and the chambered paddle of FIG. 32 shown in a separated position.
Figure 34:
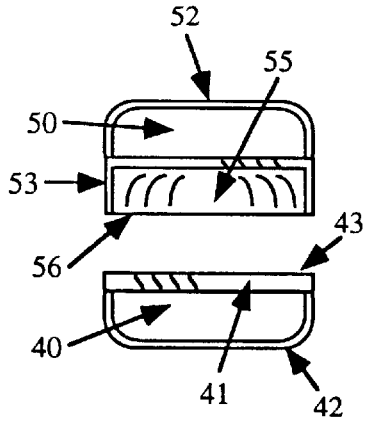
FIG. 34 is a full frontal view of the platform paddle of FIG. 30 and the chambered paddle of FIG. 32 shown in axis 34—34 and in a separated position.

A handclapper having a cavity or chamber and at least one open end is shown in FIG. 32. Both ends of the handclapper may be open, or the handclapper may comprise a cavity or chamber with no open ends. The handle is shown on this embodiment of the invention, but is not necessary to create a sound with the apparatus. A handclapper is shown in FIGS. 33 and 34 that combines the flat-faced handclapper of FIG. 28 with the chambered handclapper of FIG. 32.

Figure 28:
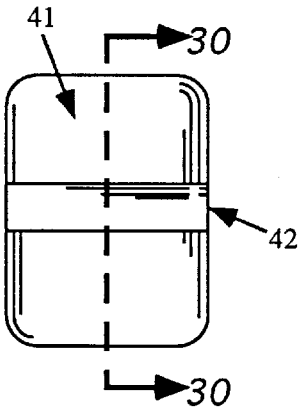
FIG. 28 shows a full top view of a paddle with a handle.

FIG. 28 is a full top view of the present invention comprising a paddle 41 with a handle 42. The paddle 41 may be gripped by an open or closed hand and moved back and forth to strike a hand, body part or other object to create a noise or audible sound.

Figure 29:
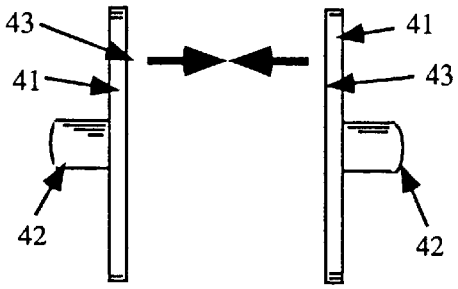
FIG. 29 illustrates a full side view of two paddles as described in FIG. 28 shown in a first separated position, where the paddles can be moved together to strike each other making an audible sound.

FIG. 29 is a full side view of two similar paddles 41 of FIG. 28 shown in a first separated position, having a body 41, a handle 42 and a face 43, where the paddles 41 can be moved together to strike each other making a noise or audible sound.

Figure 30:
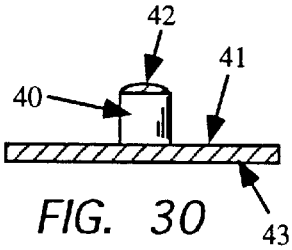
FIG. 30 is a cross sectional side view of the paddle of FIG. 28 shown in axis 30—30.

FIG. 30 is a cross sectional side view of the paddle 41 of FIG. 30 shown in axis 30—30 having a body 41, a handle 42, an aperture 40 created between the body 41 and handle 42 and a face 43.

Figure 31:
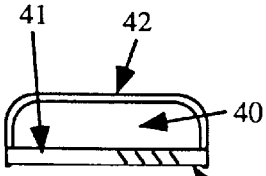
FIG. 31 is a full front view of the paddle of FIG. 30.

FIG. 31 is a full front view of the paddle 41 of FIG. 30 having a body 41, a handle 42, an aperture 40 created between the body 41 and handle 42 and a face 43.

FIG. 32 is a cross sectional side view of two paddles 53, each of the present invention, having a cavity or chamber 55, an open end 57, a closed opposite end 54, an edge or intersecting section 56, a handle 52, and an aperture 50 created between the body 53 and handle 52. A cavity or sound chamber 55 is created when the body sections are placed together. The noise emitted from striking the sections 53 together creates a sound that may be directed from the open end 57 of the applause enhancing apparatus 53 and 53.

FIG. 33 is a cross sectional side view of the platform paddle 41 of FIG. 30 and the chambered paddle 53 of FIG. 32 shown in a first separated position. The sections 41 and 53 may be moved from a first separated position, to a second striking position creating a noise or audible sound.

FIG. 34 is a full frontal view of the platform paddle 41 of FIG. 30 and the chambered paddle 53 of FIG. 32 shown in axis 34—34 and in a first separated position. The sections 41 and 53 may be moved from a first separated position, to a second striking position creating a noise or audible sound.

Figure 35:
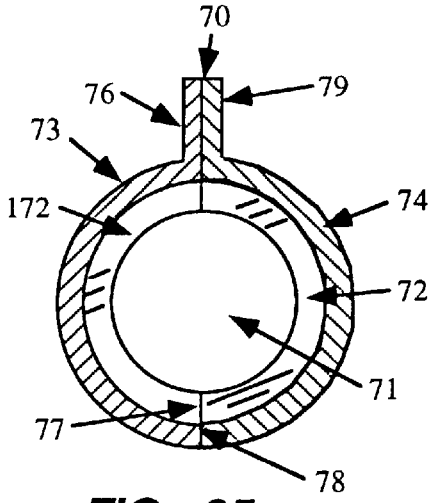
FIG. 35 is a top cross sectional view of an applause enhancing apparatus with an inner cavity with two open ends, and a bottom land or projection to hold a container within the apparatus when the sections are held together.

An applause enhancing device having a hinged handle, a cavity to hold a beverage or food container and an aperture is shown in FIG. 35 where the invention may hold a beverage or food container when the sections are joined together, be used as a megaphone when the container is removed and the sections remain joined together or maintained in close proximity, or be used to create a noise or sound like a hand clap when the sections are allowed to open and close back and forth, striking together when they close. The handle is gripped with the fingers or hand and the apparatus is moved away from and back to another hand, the body or another object. This movement allows the sections to open on the away stroke and close on the toward stroke where a sound is created when the apparatus is moved in the direction of, and makes contact with, a hand, body or other object.

Additionally, the user can hold the applause enhancing apparatus in a stationary position in one hand and create an audible sound by striking the apparatus with the other hand, or another object.

FIG. 35 is a top cross sectional view of an applause enhancing apparatus of the present invention shown in a closed position. The applause enhancing apparatus 73 and 74 may be used to hold a food or beverage container when the sections 73 and 74 are closed together, or may be used as a megaphone when the sections 73 and 74 are adjacent or together and the food or beverage container is removed, or may be used as a clapper when the food or beverage container is removed and the sections 73 and 74 are free to open and close, creating an audible sound or noise when they strike together.

Sections 73 and 74, with handles 76 and 79 respectively, being hingedly attached at hinge 70, having with an inner cavity 71 when the sections 73 and 74 are together, with two open ends, and a bottom lands or projections 172 and 72 respectively. The edges 77 and 78 of sections 73 and 74 respectively, intersect allowing the two sections to create a container when joined together. The edges 77 and 78 correspondingly contact each other and create a noise or audible sound when they strike, or close together from an opened position. The entire edge of each section 73 and 74 may create a noise or audible sound when the sections contact each other from an open position.

An applause enhancing device with a hinged handle and an inner cavity is shown in FIG. 36. The handle is shown on this embodiment of the invention, but is not necessary to create a sound with the apparatus. The lower projection or land described in FIG. 35 is not shown or necessary to hold a container when the applause enhancing container holder comprises a conical configuration where one aperture diameter is smaller than the container diameter. A cup normally is conical in shape and may correspondingly fit into the applause enhancing apparatus.

FIG. 36 is a top cross sectional view of the present invention shown in a contacting position comprising an applause enhancing apparatus 83 and 84 creating an inner cavity 81 with two open ends, a bottom aperture and without a bottom land or projection. The sections 83 and 84 are joined together at hinge 80, that is longitudinally oriented on the edge of handles 86 and 89, with corresponding edges 87 and 88 shown contacting each other.

An applause enhancing device with a fixed handle and a cavity is shown in FIG. 37 where the body hinges at the handle/body interface. A lower projection or land as shown in FIG. 35 is not included, but the applause enhancing device may include a land, so a beverage or food container may be placed within the apparatus when the sections are joined together.

FIG. 37 is a top cross sectional view of the present invention shown in a contacting position comprising an applause enhancing apparatus 94 having an inner cavity 91 or sound chamber with two open ends, a single handle 96, with the body section 94 being openable at hinge 90, that is longitudinally oriented on the edge of section 94 and handle 96. The corresponding edges 97 and 98 are shown contacting each other.

Figure 38:
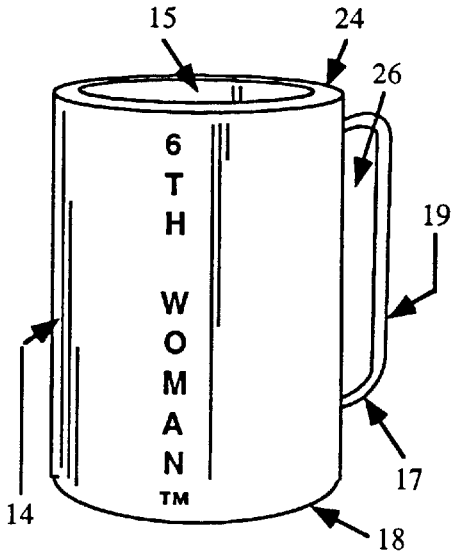
FIG. 38 shows a food or beverage container holder with a handle and an inner cavity.
Figure 39A:
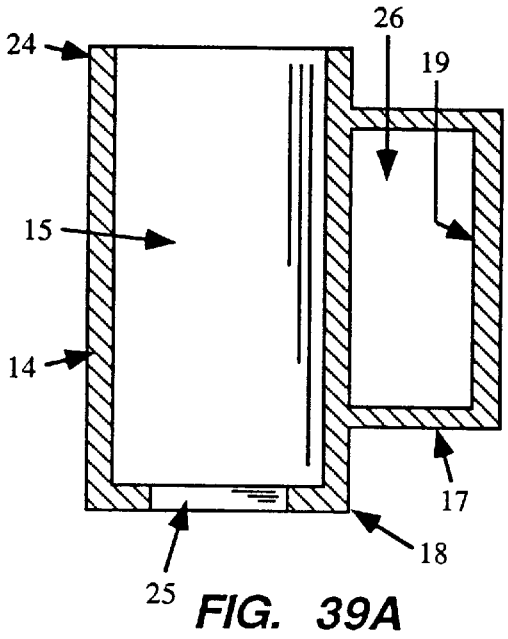
FIG. 39A is a cross sectional side view of the food or beverage container holder of FIG. 38 with a handle, an inner cavity and two open ends.
Figure 39B:
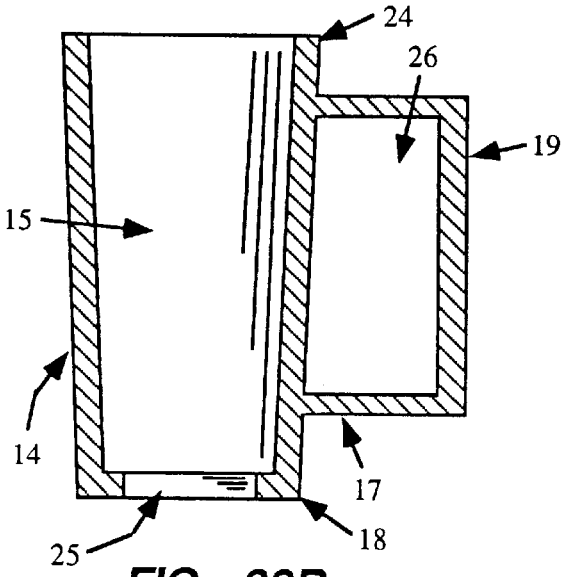
FIG. 39B illustrates the apparatus of FIG. 39A having a conical shape.
Figure 39C:
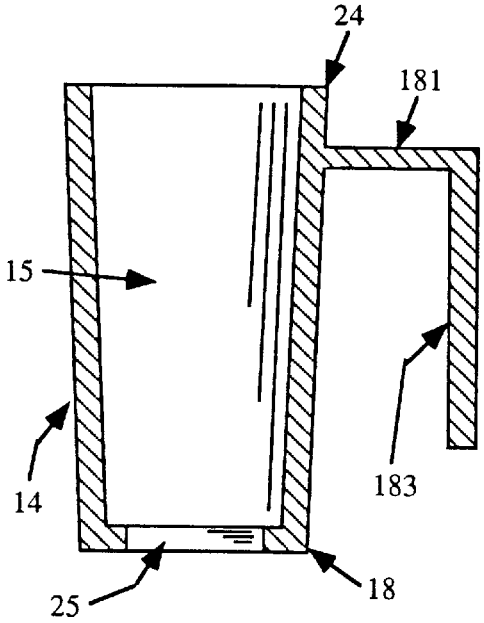
FIG. 39C illustrates an applause enhancing apparatus of the present invention having a conical shape, and an "L" shaped handle that allows the apparatus to be stacked prior to use.

A unitary applause enhancing device with a fixed handle, a cavity to hold a beverage or food container and an aperture is shown in FIGS. 38, 39A–39C, where the invention may hold a beverage or food container, or be used as a megaphone when the container is removed. Although shown, the handle does not have to be included for the invention to hold a container or be used as a megaphone. The invention may also include a conical, or other configurations cited in this application. The user may create an audible sound like a handclap by striking the unitary applause enhancing device against another object, such as a hand, other body part, or a separate object. FIG. 39C shows an applause enhancing apparatus of the present invention that can easily stacked together prior to use.

FIG. 38 is a full side view of the present invention comprising a one-piece applause enhancing apparatus 14 for holding food or a beverage, or a food or beverage container. The applause enhancing apparatus 14 having bottom 18, a top lip or edge 24, an inner cavity 15 open to the top of the apparatus 14, a handle 19 connected to the apparatus by a rail 17 and an aperture 26 for inserting fingers or a hand through for gripping the apparatus 14. The applause enhancing apparatus may be held by a hand and moved to strike an object, creating an audible sound or noise. The handle 19 is shown, but is not necessary to create an audible sound or noise with the apparatus 14.

FIG. 39A is a cross sectional side view of a unitary applause enhancing apparatus having a bottom 18, a top lip or edge 24, an inner cavity 15 open to the top of the apparatus 14, a handle 19 connected to the apparatus by a plurality of rails 17 and an aperture 26 for inserting fingers or a hand through for gripping the apparatus 14. Bottom 18 may also include an aperture 25 to allow apparatus 14 to be used as a megaphone.

FIG. 39B is a side cross sectional view of a one-piece, conically shaped applause enhancing apparatus with two open ends comprising a body 14, an inner cavity or chamber 15, a top lip or opening 24, a handle 19 attached to body 14 by a plurality of rails 17 with an aperture 26 that is sufficient in size to insert a hand into, and a bottom 18 having an aperture 25. The user may position the applause enhancing apparatus 14 near the mouth and shout into aperture 25, aiming a voice in a desired direction. Body 14 may be used to strike another object, creating an audible sound.

FIG. 39C is a side cross sectional view of a stackable, one-piece, conically shaped applause enhancing apparatus with two open ends comprising a body 14, an inner cavity or chamber 15, a top lip or opening 24, a handle 19 attached to body 14 by at least one rail 17 with an aperture 26 that is sufficient in size to insert a hand into, and a bottom 18 having an aperture 25. The user may position the applause enhancing apparatus 14 near the mouth and shout into aperture 25, aiming a voice in a desired direction. Body 14 may be used to strike another object, creating an audible sound.

Figure 40:
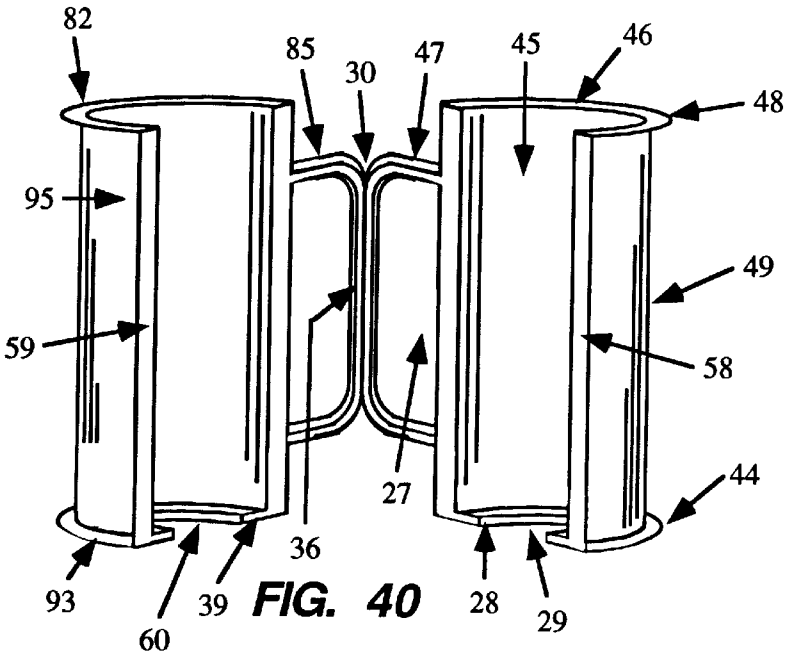
FIG. 40 is a full side view of an applause enhancing apparatus with hinged handles shown in a separated or open position.

FIG. 40 shows a full side view of the applause enhancing apparatus of the present invention in an opened position with an inner cavity, a bottom land for holding a food or beverage container when the apparatus is closed, with corresponding handles joined together by a hinge.

FIG. 40 is a full side view of the present invention comprising an applause enhancing apparatus 49 and 95 with uniformly thick wall sections connected at longitudinally oriented hinge 30 and shown in a non-contacting, or open position. The applause enhancing apparatus 95 and 49 may be closed and used to hold a food or beverage container, or may be used as a megaphone, or be used as a clapper or noise maker by shaking the apparatus back and forth where the sections 95 and 49 strike each other.

The applause enhancing apparatus 95 and 49 having corresponding top edges or lips 82 and 48, bottom edges 93 and 44, intersection edges 59 and 58, bottom projections or lands 39 and 28, an open top end 46 and an open bottom ends 60 and 29, and handle rails 85 and 47 that share a common hinge 30, an inner cavity or sound chamber 45 and an aperture 27 for inserting a hand or finger into.

Figure 41:
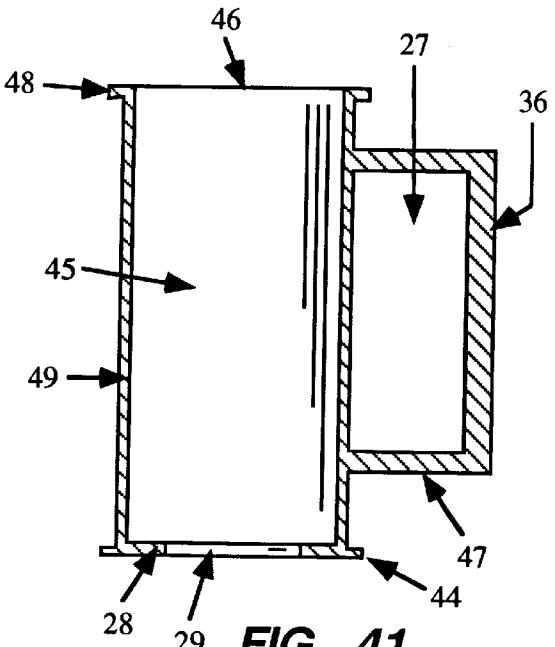
FIG. 41 illustrates a cross sectional side view of the applause enhancing apparatus of FIG. 40 with a handle, an inner cavity, two open ends and uniformly thick wall section.
Figure 42:
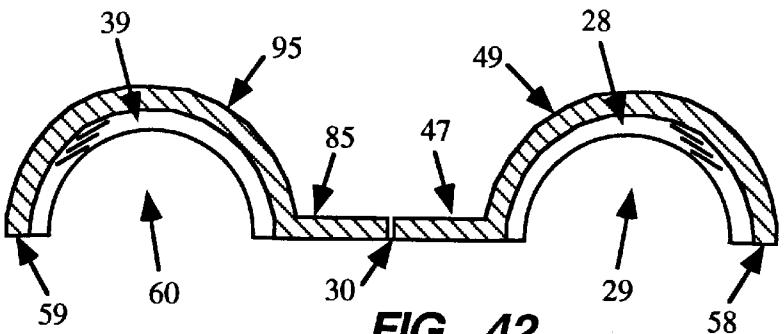
FIG. 42 shows a cross sectional top view of the applause enhancing apparatus in an open-faced configuration; This configuration is possible using standard injection molding tooling and processes.

FIG. 41 shows an applause enhancing apparatus having a consistent wall thickness throughout with a hinged handle, a cavity to hold a beverage or food container and two open ends, where the invention may hold a beverage or food container when the sections are joined together, be used as a megaphone when the container is removed and the sections remain joined together, or be used to create a noise or sound like a hand clap when the sections are allowed to open and close, striking together when they close. A consistent wall thickness makes the invention easily manufacturable with standard injection mold practices. Virgin, recycled material, or a combination of both, may be used to manufacture the applause enhancing apparatus. FIG. 42 shows one configuration of how the present invention may be injection molded or manufactured in an open-faced configuration.

FIG. 41 is a cross sectional side view of the applause enhancing apparatus of FIG. 40 having an inner cavity or sound chamber 45, a top opening 46 a top lip 48, a bottom lip 44, a bottom inner projection or land 28, a lower aperture 29, a rail 47 attaching the body 49 to handle 36, and an aperture 27 for inserting a hand through.

FIG. 42 is a top cross sectional view of the applause enhancing apparatus shown in FIG. 40 in an open face configuration where a number of features may be included into the apparatus by plastic injection processes. The applause enhancing apparatus 95 and 49 having respective body sections 95 and 49, edges 59 and 58, bottom lands or projections 39 and 28, handles 85 and 47 that share a common living hinge 30, and a uniformly thick wall sections.

As a matter of practicality, disposable cups are used to hold beverages at large sporting and entertainment events. Cans or bottles are not use because they pose a hazard by trapping the contents in the container and may be thrown by rowdy fans. A cupholder and cup are shown in FIG. 43 (full side view) and FIG. 47 (cross sectional side view) where a cup is inserted in a megaphone cupholder.

The cupholding megaphone is shown in FIGS. 43–47. A gripping means may be included on the external surface, as shown in FIG. 46B, or internally , as shown in FIG. 46A, where internal projections suspend the cup within the megaphone cup holder. A handle for gripping the applause enhancing apparatus may also be included on the cupholding megaphone. The external gripping means may also comprise annular rings, serrations or the like that create an improved gripping means. When the cup is removed from the megaphone cupholder, the apparatus may be used as a megaphone. A mark or indicia can be placed on the cupholder or cup. The cupholder may also comprise an insulating means.

Figure 43:
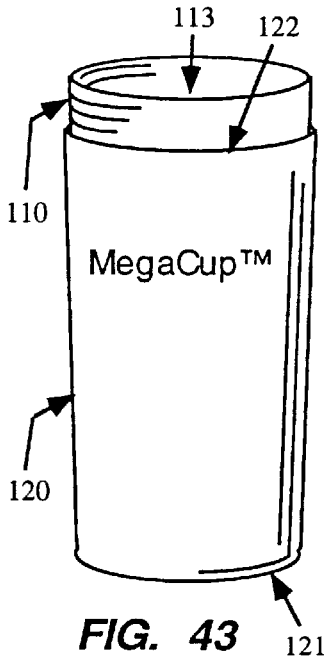
FIG. 43 shows a full side view of a cup and separable megaphone that are removably stacked together.

FIG. 43 is a full side view of the present invention comprising a cup 110 and cupholding megaphone 120 stacked together. The cup 110 and cupholding megaphone 120 are selectively separable and may be manufactured from paper or wood products, plastic, or any material suitable to hold liquid or food. The material may be coated with wax or the like and the cup 110 and megaphone 120 may be selectively held together by an adhesive or bonding material so they remain together while a beverage or food is consumed, yet are easily separable whenever the user so desires.

The megaphone 120 comprises a top 122, a bottom 121 and is shown as a cup holder, but may be placed inside the cup 110 as well. The cup 110 comprises an inner cavity 113 that is fillable with a food or beverage and open at the top 14 and closed at the bottom 111 and base 112. The cupholding megaphone may also hold a bottle bag, or can. The cupholding megaphone 120 is shown in a conical configuration, but may comprise any number of configurations that allows a container to be held within a cupholding megaphone. A mark, logo, or indicia may also be included on the cupholding megaphone 120.

A hidden message may be included on the inside wall section of the cupholding megaphone or on the outside wall of the cup that is inserted inside the cupholding megaphone. This may be used to identify a prize in a contest or sweepstakes.

Figure 44:
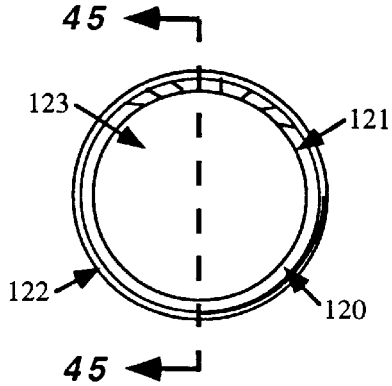
FIG. 44 shows a full top view of the cup holder and megaphone of FIG. 43.

FIG. 44 is a full top view of the cupholding megaphone of FIG. 43 having a body 120, a top edge 122, a bottom edge 121, and an inner cavity or sound chamber 123. Both the cup 110 and megaphone 120 are of a similar conical configuration where they stack closely together.

Figure 45:
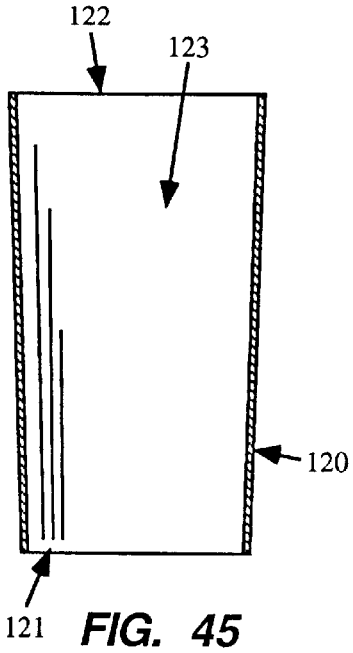
FIG. 45 shows a cross sectional side view of the cup holder and megaphone of FIG. 44.

FIG. 45 shows a cross sectional side view of the megaphone of FIG. 44 shown in axis 45—45, having a top edge 122, a bottom edge 123, and an inner cavity or sound chamber 123.

Figure 46A:
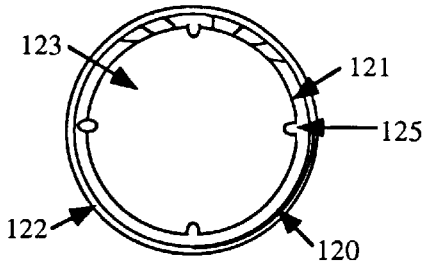
FIG. 46A shows a full top view of a cup holder and megaphone of the present invention with a plurality of internal projections.

FIG. 46A is a full top view of the cupholding megaphone of FIG. 43 having a top edge 122, a bottom edge 121, an inner cavity or sound chamber 123, and internal projections 125 for suspending a cup within a cupholding megaphone. The internal projections 125 may also provide structural stability.

Figure 46B:
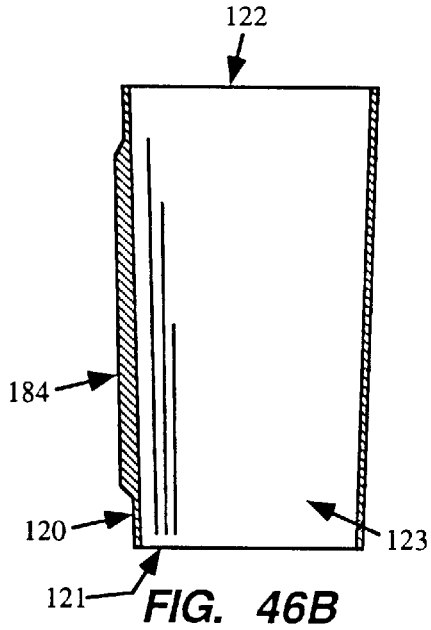
FIG. 46B shows a side cross sectional view of a cup holder and megaphone of the present invention with at least one external projection.

FIG. 46B is a cross sectional side view of the cupholding megaphone of FIG. 43 having a top edge 122, a bottom edge 121, an inner cavity or sound chamber 123, and a longitudinally oriented external projection 184 for improved gripping means. The external gripping means may also comprise annular rings, serrations or the like that create an improved gripping means.

Figure 47:
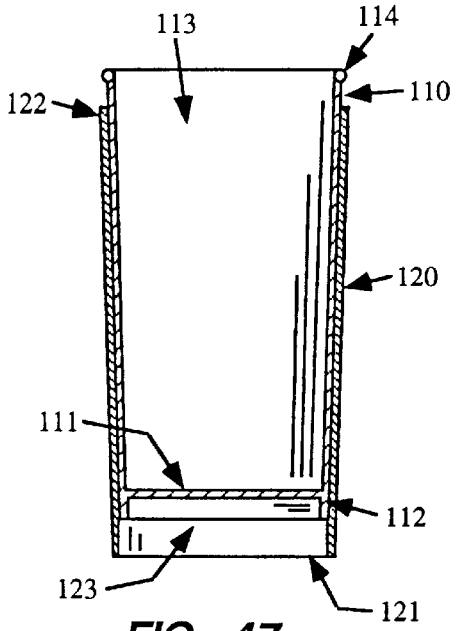
FIG. 47 shows a cross sectional side view of the cup holder and separable megaphone of FIG. 44 that are removably stacked together.

FIG. 47 is a cross sectional side view of the cup 110 and cupholding megaphone 120 of FIG. 43 being stacked together. The cup 110 and cupholding megaphone 120 are selectively separable. The cup includes a top lip 114, a bottom 111, a foot or base 112 and an inner cavity 113. The cupholding megaphone 120 comprises a top 122, a bottom 121 and an inner cavity 123. The cup 110 may include an expanding and contracting side wall so when a beverage or food product are placed inside the cup, the side wall expands and frictionally engages the cupholding megaphone.

Figure 48:
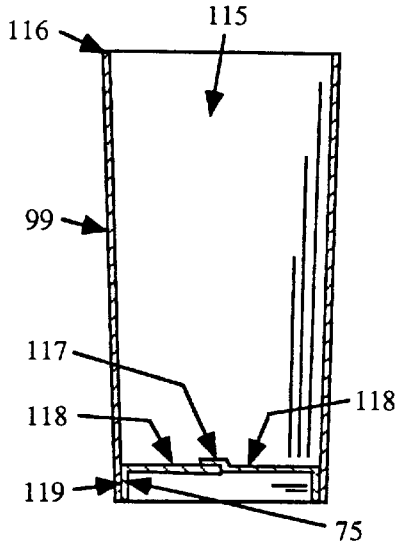
FIG. 48 shows a full side view of a container of the present invention with a liquid-tight, openable bottom comprising a plurality of sealed and joined sections forming the bottom of the cup; The bottom of the cup may comprise at least one openable or removable section.
Figure 49:
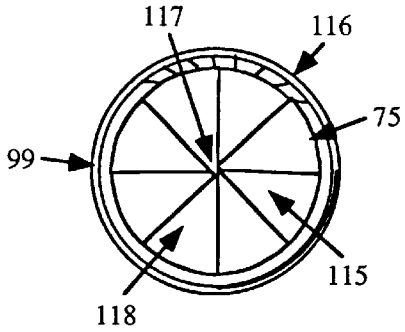
FIG. 49 shows a full top view of the apparatus of FIG. 48 with a joined, sealed bottom forming a liquid-tight barrier, that is selectively openable.

The invention may also comprise a cup with an openable bottom shown in FIGS. 48 and 49. A cup or container with a removable bottom that is integrally manufactured into the container is shown in FIGS. 50A–50D and 51.

FIG. 48 is a cross sectional side view of the present invention comprising a cup 99 with at least one selectively openable or removable bottom section 118 and a foot or base 119. A food or beverage are placed inside the cavity 115 of cup 99, consumed and the user opens the bottom section 118 of the cup 99 so it may be used as a megaphone. An openable or removable liquid-tight, seal is formed by at least one bottom section 118 that form the bottom of the cup and are sealed at overlapping section 117. The bottom circumference or perimeter is sealed by seal 75. The cup 99 may be manufactured from paper or wood products, plastic, or any material suitable to hold liquid or food. The material may be coated with wax or the like.

FIG. 49 is a full top view of the megaphone cup 99 of FIG. 48 comprising a body 99, a top lip or edge 116, an inner cavity 115, with a plurality of selectively openable bottom sections 118 that create a liquid-tight, seal that overlap at seal 117.

Figure 50A:
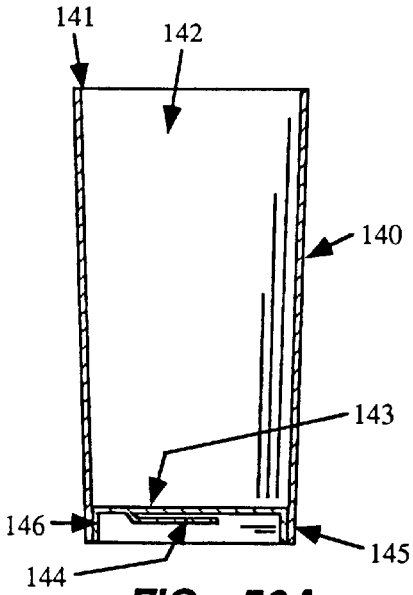
FIG. 50A illustrates a cross sectional side view of a container of the present invention with a removable bottom.

FIG. 50A is a cross sectional side the present invention comprising a cup 140 having an inner cavity or chamber 142, a top edge or lip 141, a selectively openable or removable bottom 143 with a pull tab 144 and a foot or base 146. A food or beverage are placed inside the cavity 142 of cup 140, consumed and the user removes the bottom 143 of the cup 140 so it may be used as a megaphone. An openable or removable liquid-tight, seal is formed by at least one bottom section 143 that may include a pull tab 144 or the like for easy removal of bottom 143 from cup 140. The bottom circumference or perimeter is sealed by seal 145. The cup 140 may be manufactured from paper or wood products, plastic, or any material suitable to hold liquid or food. The material may be coated with wax or the like.

Figure 50B:
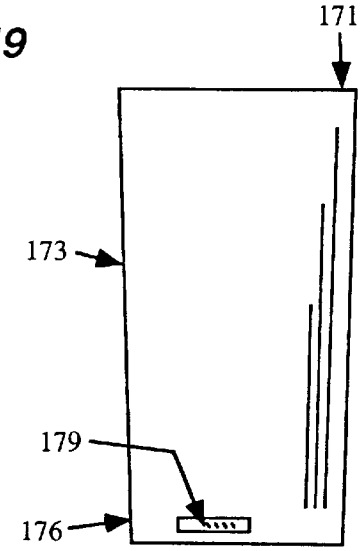
FIG. 50B illustrates a full side view of a container of the present invention having an integral, removable bottom, and a slot or aperture in the foot of the container.

FIG. 50B is a full side view of the present invention comprising a unitary cup 173 with a selectively openable or removable bottom having an inner cavity or chamber, a top edge or lip 171, a foot or base 176 and an aperture 179 that allows the pull tab, later described, to be integrally manufactured into container 173. Aperture 179 allows a movable core to be positioned in bottom of container 173 using conventional injection molding processes to create pull tab 175.

Figure 50D:
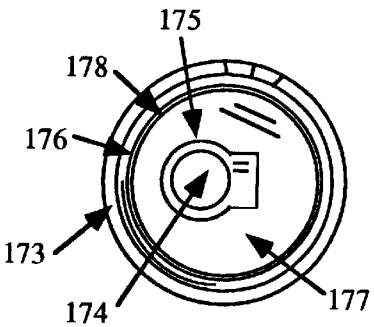
FIG. 50D illustrates a full, bottom view of a container of FIG. 50B.
Figure 50C:
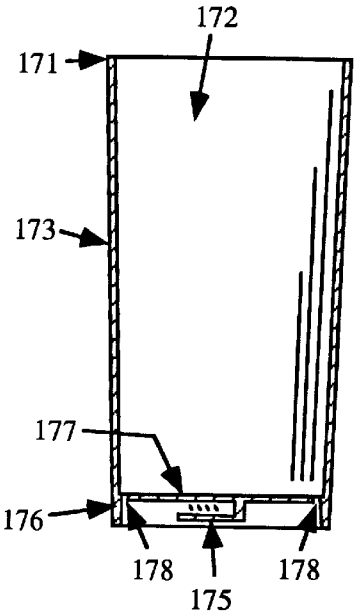
FIG. 50C illustrates a cross sectional side view of a container of FIG. 50B.

FIG. 50C is a cross sectional side view of the apparatus of FIG. 50B, comprising a unitary cup 173 with a selectively openable or removable, integrally manufactured bottom 177 having a pull tab 175, an inner cavity or chamber 172, a top edge or lip 171, a foot or base 176. A food or beverage are placed inside the cavity of cup 173, consumed and the user removes the bottom 177 of the cup 173 so it may be used as a megaphone. An openable or removable liquid-tight, seal 178 is integrally molded into a selectively removable bottom section 177 that includes pull tab 175 or the like for easy removal of bottom 177 from cup 173. The bottom circumference or perimeter is sealed by seal 178. The cup 173 may be manufactured from coated paper or coated wood products, plastic, or any material suitable to hold liquid or food.

FIG. 50D is a full bottom view of the apparatus of FIG. 50C, comprising a unitary megaphone cup 173 with a selectively openable or removable bottom 177, having a pull tab 75 with an aperture 174 that allows tab 175 to be gripped, bottom 177 sealed by integrally manufactured seal 178. A food or beverage are placed inside the cavity of cup 173, consumed and the user removes the bottom 177 of the cup 173 so it may be used as a megaphone.

Figure 53:
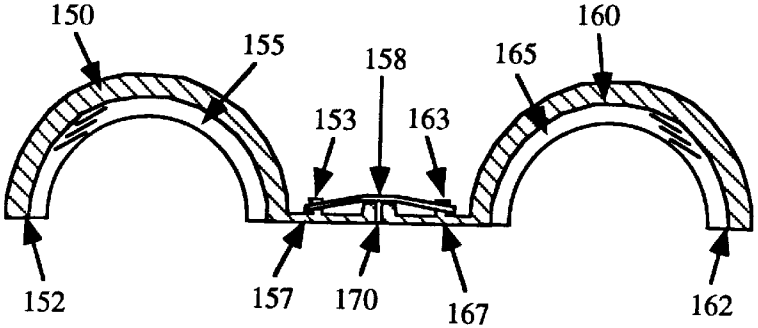
FIG. 53 is a cross sectional top view of the applause enhancing apparatus of FIG. 52 shown in a open faced position.
Figure 54:
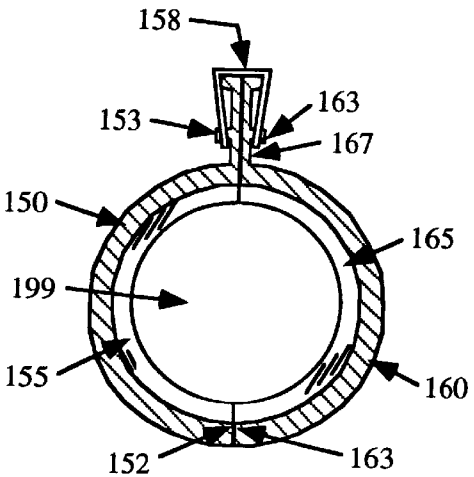
FIG. 54 is a cross sectional top view of the applause enhancing apparatus of FIG. 52 shown in a closed position with a bias being placed on the sections.
Figure 55A:
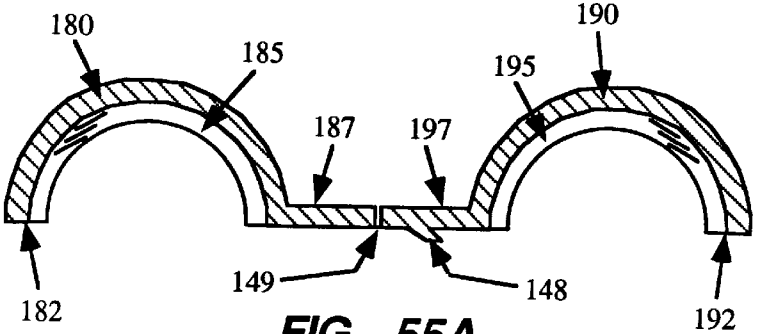
FIG. 55A is a cross sectional top view of an applause enhancing apparatus shown in a open faced position having a integral biasing means that is activated when the sections are contacting each other.
Figure 55B:
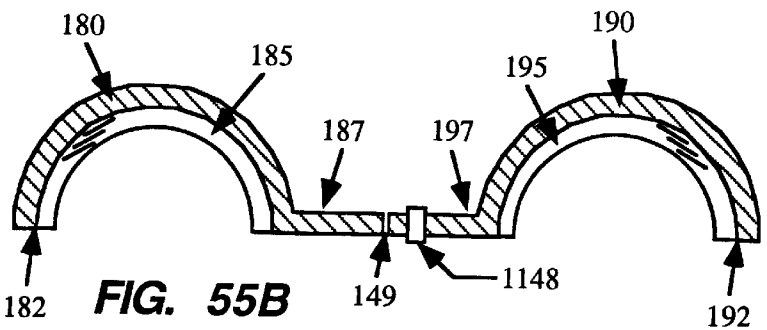
FIG. 55B is a cross sectional top view of an applause enhancing apparatus shown in a open faced position having a separate biasing means that is activated when the sections are contacting each other.

An applause enhancing apparatus having a biasing means to move the sections of the apparatus toward a non-contacting, or open position are shown in FIGS. 52–55B. A resilient member or rubber band is described in FIGS. 52–54 that provides a biasing means to open the apparatus. An integral member for biasing the apparatus sections toward an open position is shown in FIG. 55. A coil, leaf, torsion spring or the like may also be included in the apparatus to urge the sections apart. A separate component for biasing the components in a non-contacting, or open position are shown in FIG. 55B.

A spring clip or resilient member may also be included to urge the sections of the applause enhancing apparatus to a closed, or contacting position.

A means to mechanically keep the sections of the applause enhancing apparatus closed when an object or cup is inserted in the apparatus cavity may also be included.

Figure 51:
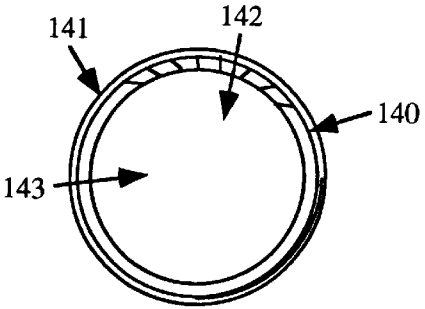
FIG. 51 is a full top view of the container of FIG. 50A.

FIG. 51 is a full top view of the megaphone cup of FIG. 50A having a body 140 an inner cavity or chamber 142, a permanently removable bottom 143 and a top edge 141.

Figure 52:
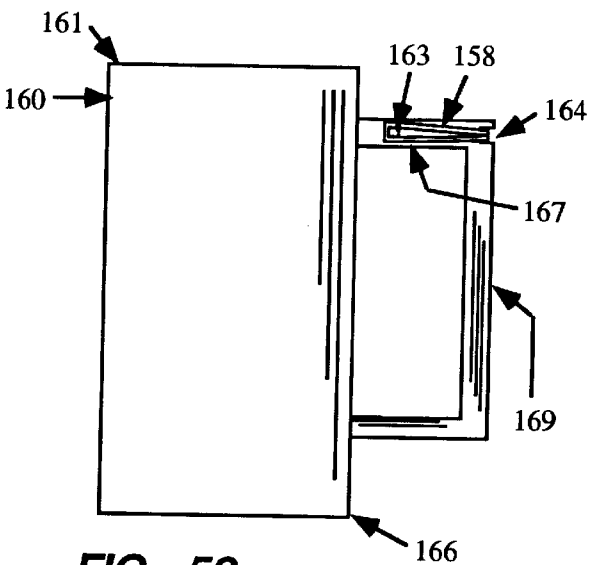
FIG. 52 is a full side view of an applause enhancing apparatus having a biasing means to move the apparatus sections apart, relative to each other.

FIG. 52 is a full side view of the present invention comprising an applause enhancing apparatus having a body 160, a top edge 161, a base 166, a handle 169 being connected to the body by a rail 167 including a post or projection 163 and a recess 164 for holding a resilient member or rubber band 158 for maintaining an opening biasing force on the sections of the apparatus, relative to each other. The rubber band 158 is hooked on the post 163, that also may be recessed relative to the outer surface of the rail 167. An object or cup may be inserted in the apparatus 160 when the sections are maintained together.

FIG. 53 is a cross sectional view of the applause enhancing apparatus of FIG. 52 shown in a open faced position, having corresponding components including bodies 150 and 160, edges 152 and 162 that contact each other to hold an object of cup inside or within the apparatus, or create a noise or audible sound when the sections are moved swiftly from an open position to a closed position, rails 157 and 167 having posts 153 and 163 for holding a rubber band or resilient member 158, bottom projections 155 and 165 that serve as a land when the sections are closed and an object is inserted in the apparatus, and a hinge section 170 that is bendable.

FIG. 54 is a cross sectional top view of the applause enhancing apparatus of FIGS. 52 and 53 shown in a closed or contacting position, having corresponding components including bodies 150 and 160, edges 152 and 162 shown contacting each other to hold an object of cup inside or within the apparatus, or create a noise or audible sound when the sections are moved swiftly from an open position to a closed position, rails 157 and 167 having posts 153 and 163 for holding a rubber band or resilient member 158 in a tensioned position, bottom projections 155 and 165 that serve as a land when the sections are closed and an object is inserted in the apparatus, and a hinge section 170 that is bendable. An inner cavity 199 is fillable with a container or object and creates a sound chamber when the sections strike each other. The cavity 199 also serves to aim a voice or sound in a directional manner.

FIG. 55A is a cross sectional view of the present invention shown in a open faced configuration comprising an applause enhancing apparatus having an integral opening biasing means 148, corresponding components including bodies 180 and 190, edges 182 and 192 that contact each other to hold an object of cup inside or within the apparatus, or create a noise or audible sound when the sections are moved swiftly from an open position to a closed position, rails 187 and 197 that connect a handle (not shown) to the body of the apparatus, with an integral projection that biases the sections toward an open position, relative to each other when the sections are moved to a contacting position, bottom projections 185 and 195 that serve as a land when the sections are closed and an object is inserted in the apparatus, and a hinge section 149 that is bendable.

FIG. 55B is a cross sectional view of the present invention shown in a open faced configuration comprising an applause enhancing apparatus having a separate opening biasing means 1148, corresponding components including bodies 180 and 190, edges 182 and 192 that contact each other to hold an object of cup inside or within the apparatus, or create a noise or audible sound when the sections are moved swiftly from an open position to a closed position, rails 187 and 197 that connect a handle (not shown) to the body of the apparatus, with an integral projection that biases the sections toward an open position, relative to each other when the sections are moved to a contacting position, bottom projections 185 and 195 that serve as a land when the sections are closed and an object is inserted in the apparatus, and a hinge section 149 that is bendable.

Figure 56A:
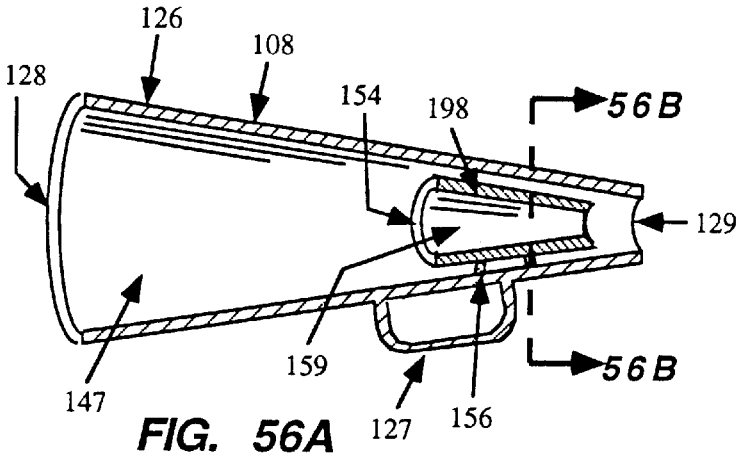
FIG. 56A is a cross sectional side view of a full size megaphone having an applause enhancing apparatus of the present invention residing within the megaphone.
Figure 56C:
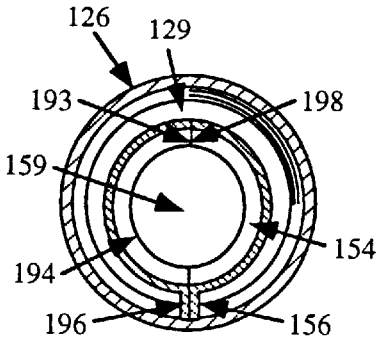
FIG. 56C is a cross sectional rear view of the apparatus of FIG. 56B, having an applause enhancing apparatus of the present invention shown in a contacting position, creating an audible sound.
Figure 56B:
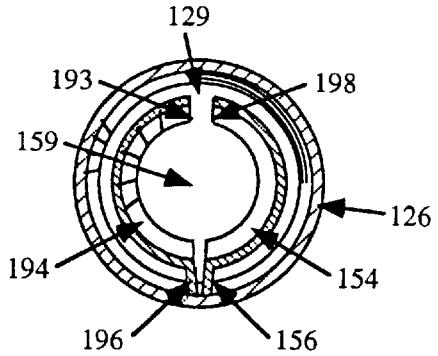
FIG. 56B is a cross sectional rear view of the apparatus of FIG. 56A shown in axis 56B—56B, having an applause enhancing apparatus of the present invention shown in a non-contacting position.

FIGS. 56A–56C show the applause enhancing apparatus of the present invention combined with a large megaphone. The user can strike the outside of the large megaphone on a hand, body part, object or the like in a normal fashion to create a sound. The applause enhancing apparatus of the present invention is included in the interior chamber of the megaphone and an additional sound will be generated by the applause enhancing apparatus sections striking together when the megaphone is struck against another object. The user may still project a voice through the megaphone that includes the applause enhancing apparatus of the present invention.

FIG. 56A is cross sectional side view of a megaphone with an applause enhancing apparatus of the present invention residing within the megaphone. The conical megaphone 126 having a wall section 108, a large open end 128, a smaller open end 129, a handle 127, and an inner chamber 147 where a noise making apparatus 154 resides, having an inner chamber 159 and intersecting section 198 mounted within megaphone 126, apparatus 154 being attached to megaphone 126 by at least one connector 156 and apparatus 154 being movable from a first, non-contacting position, to a second contacting position with corresponding apparatus, shown is FIGS. 56B and 56C, creating an audible sound. The user may still project a voice through the megaphone that includes the applause enhancing apparatus of the present invention.

FIG. 56B is cross sectional rear view of apparatus of FIG. 56A shown in axis 56B—56B, with internal applause enhancer 154 and 194 in a first, ready-to-use, non-contacting position. Applause enhancer 154 and 194 having intersecting sections 198 and 193 respectively, that create an audible sound when they contact each other, applause enhancer 154 and 194 being mounted to megaphone 126 by connectors 156 and 196 respectively. Conical megaphone 126 having a smaller open end 129, where applause enhancer 154 and 194 is located, allowing user to project a voice through megaphone 126. Conical megaphone 126 amplifies audible sound created by internal applause enhancer 154 and 194.

FIG. 56C is a cross sectional rear view of apparatus of FIG. 56B, with internal applause enhancer 154 and 194 shown in a second, contacting position creating an audible sound when megaphone 126 is moved back and forth, or is moved to contact a hand, body part or other object.

FIGS. 57–61 show a one-piece applause enhancing apparatus of the present invention where the apparatus is molded in a open-faced configuration and is foldable into an applause enhancing apparatus that includes a handle with a plurality of hinge sections, a means to join the sections together adjacent to each other, a limiting means to maintain the sections in a position to hold a container, allow the applause enhancing apparatus to be used as a megaphone or a handclapper, where a projection is included to prevent the sections from pinching the users hand during use.

This embodiment maintains the sections adjacent to each other in a ready to use state, but in a non-contacting position, so when the user moves the applause enhancing apparatus toward another object to strike it, an audible sound is created when the sections strike each other. Since the sections are biased in a non-contacting position, this embodiment may also be moved back and forth in a sufficient manner to strike together creating an audible sound without striking another separate object.

Figure 57:
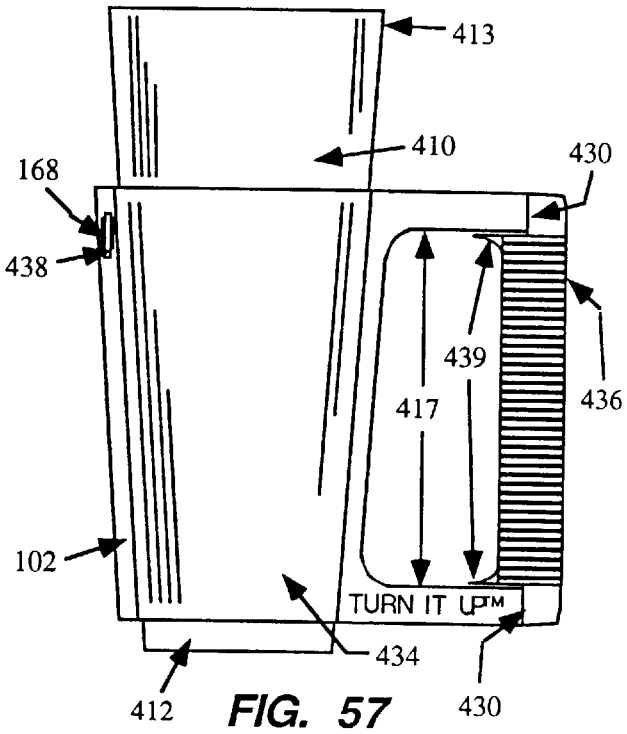
FIG. 57 is a full side view of a prior art container being held in the applause enhancing apparatus of the present invention having a handle, a plurality of hinges, a limiting means, and at least one projection that provides an anti-pinching means.

FIG. 57 is a full side view of an applause enhancing apparatus of the present invention holding a prior art container, comprising a cup 410, a base 412 and an open end 413. Applause enhancing apparatus 434 having an edge 102, a handle 436, and a plurality of hinges 430 attached to corresponding rails 417 that connect handle 436 to apparatus 434. Apparatus having a limiting means comprising a projection or barb 438 that is selectively insertable into slot 168. Bendable barb 438 is manufactured in a flat configuration and is folded at approximately 90° and inserted in slot 168 allowing separable sections 434 and 433, shown in subsequent drawings, to move back and forth to and from a non-contacting position to a contacting position, creating an audible sound. Handle 436 having a projection 439 to prevent user from pinching fingers or the like as separable sections 434 and 433 move back and forth.

Figure 58:
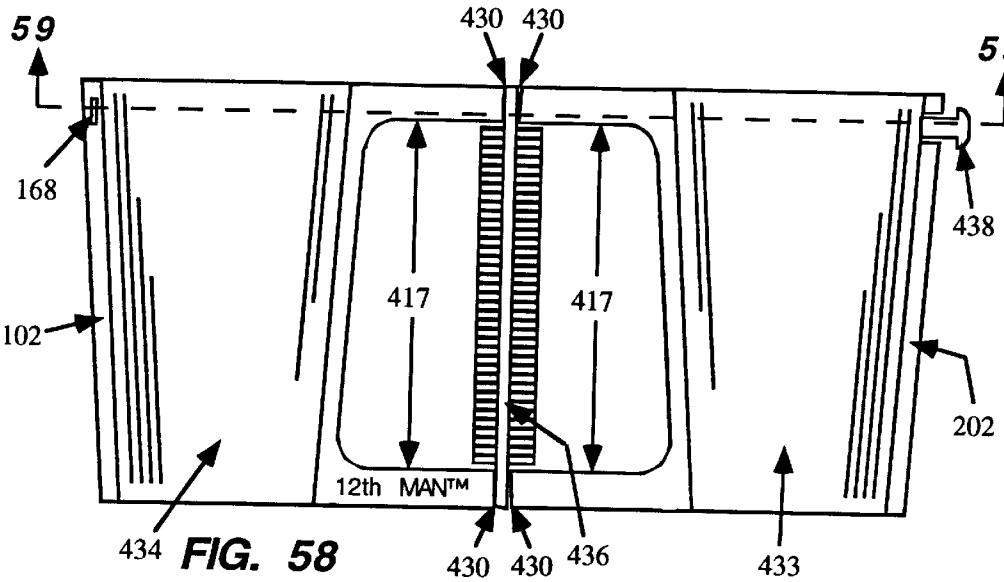
FIG. 58 is a full outside face view of the apparatus of FIG. 57 shown in an open-faced configuration having one handle and a plurality of hinges.

FIG. 58 is a full outside face view of an applause enhancing apparatus of FIG. 57 shown in an open-faced configuration that is manufacturable using conventional injection molding processes, having corresponding body sections 433 and 434, intersecting sections 202 and 102 respectively, cavities 431 and 432 respectively, a common handle 436, a plurality of hinges 430 attached to corresponding rails 417 that connect handle 436 to apparatus 434 and 434, a slot or aperture 168 to receive bendable barb 438 to limit separable movement of sections 434 and 433, and at least one projection 439 that serves as an anti-pinching means.

Figure 59:
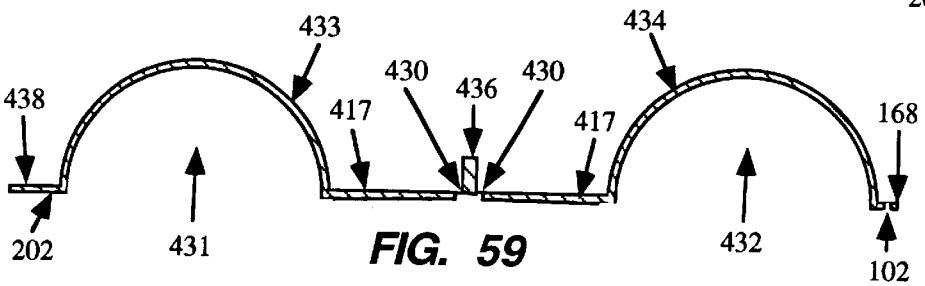
FIG. 59 is a cross sectional top view of the apparatus of FIG. 58 shown in an open-faced configuration having one handle, a plurality of hinges, a plurality of cavities, an aperture and a corresponding limiting means.

FIG. 59 is a cross sectional view of the apparatus of FIG. 58 shown in axis 59—59 having corresponding body sections 433 and 434, intersecting sections 202 and 102 respectively, cavities 431 and 432 respectively, a common handle 436, a plurality of hinges 430 attached to corresponding rails 417 that connect handle 436 to apparatus 434 and 434, a slot or aperture 168 to receive bendable barb 438 to limit separable movement of sections 434 and 433.

Figure 60:
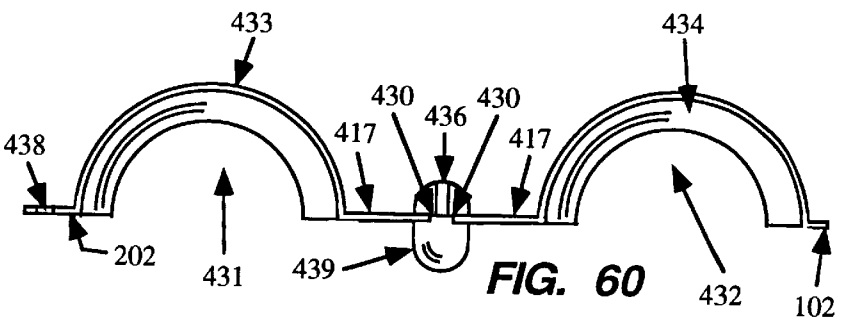
FIG. 60 is a full top view of the apparatus of FIG. 58 shown in an open-faced configuration having one handle, a plurality of hinges, a plurality of cavities, a limiting means and an anti-pinching means.

FIG. 60 is a full top view of the apparatus of FIG. 58 shown in an open-faced configuration having corresponding body sections 433 and 434, intersecting edges 202 and 102 respectively, cavities 431 and 432 respectively, a common handle 436, a plurality of hinges 430 attached to corresponding rails 417 that connect handle 436 to apparatus 433 and 434, a slot or aperture 168, not shown here on edge 102, to receive bendable barb 438 to limit separable movement of sections 434 and 433.

Figure 61:
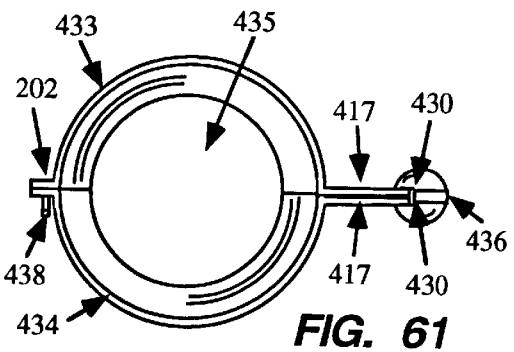
FIG. 61 is a full top view of the apparatus of FIG. 58 shown in an closed configuration having one handle, a plurality of hinges, a plurality sections that create a chamber and a limiting means.

FIG. 61 full top view of the apparatus of FIG. 58 shown in a closed, or contacting configuration having corresponding body sections 433 and 434, intersecting at edges 202 and 102 respectively creating an audible sound, cavities 431 and 432 respectively now create chamber 435, a common handle 436, a plurality of hinges 430 attached to corresponding rails 417 that connect handle 436 to apparatus 434 and 434, a slot or aperture 168, not shown here on edge 102, to receive bendable barb 438 to limit separable movement of sections 434 and 433.

FIGS. 62–65 show a one-piece applause enhancing apparatus of the present invention where the apparatus is molded in a open-faced configuration and is easily stackable for storage and shipping prior to use. The applause enhancing apparatus is also foldable into an applause enhancing apparatus that includes a handle with a hinge section, a means to join the sections together, a limiting means to maintain the sections in a position to hold a container, and allow the applause enhancing apparatus to be used as a megaphone or a handclapper, where a projection is included to prevent the sections from pinching the users hand during use. This embodiment of the present invention includes a biasing means to maintain the sections of the applause enhancing apparatus in a non-contacting position, so the applause enhancing apparatus will automatically ruturn to a non-contacting position after the user strikes the apparatus together creating an audible sound.

This embodiment also maintains the sections adjacent to each other in a ready to use state, but in a non-contacting position, so when the user moves the applause enhancing apparatus toward another object to strike it, an audible sound is created when the sections strike each other. Since the sections are biased in a non-contacting position, this embodiment may also be moved back and forth in a sufficient manner to strike together creating an audible sound without striking another separate object.

Figure 62:
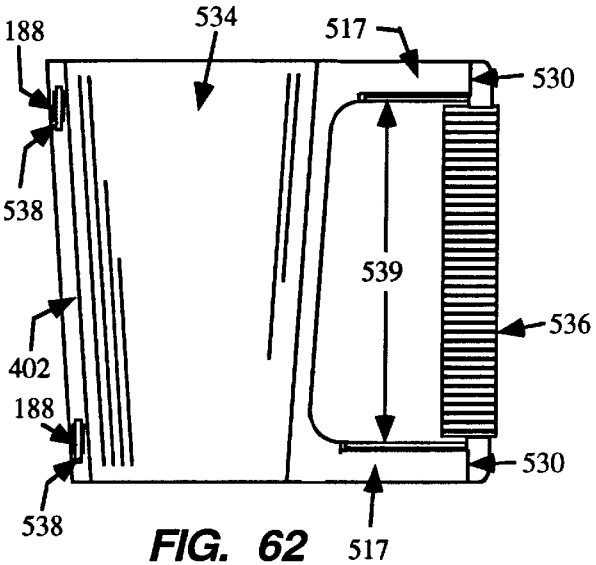
FIG. 62 is a full side view of the applause enhancing apparatus of the present invention having a handle, a plurality of hinges, a limiting means, and at least one projection that provides an anti-pinching means.

FIG. 62 is a full side view of an applause enhancing apparatus of the present invention that is manufacturable and stackable in an open-faced configuration, showing another embodiment of the anti-pinching means. Applause enhancing apparatus 534 having an edge 402, a crescent shaped handle 536, and a plurality of hinges 530 attached to corresponding rails 517 that connect handle 536 to apparatus 534. Apparatus having a limiting means comprising a plurality of projections or barbs 538 that are selectively insertable into slots 188. Bendable barbs 538 are manufactured in a flat configuration and are folded at approximately 90° and inserted in slots 188 allowing separable sections 434 and 433, shown in subsequent drawings, to move back and forth to and from a non-contacting position to a contacting position, creating an audible sound. Handle 536 having movable projections 539 preventing user from pinching fingers or the like as separable sections 534 and 533 move back and forth.

Figure 63:
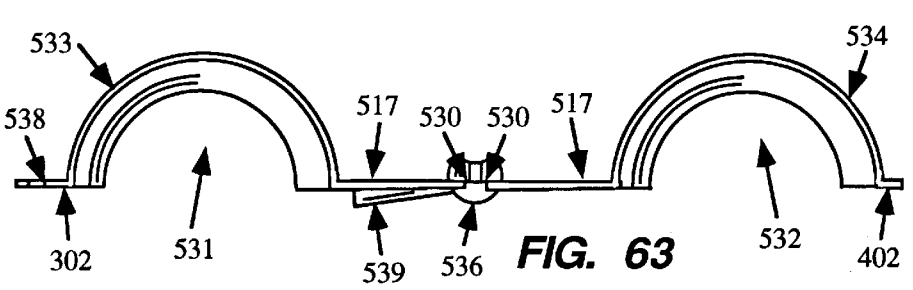
FIG. 63 is a full top view of the apparatus of FIG. 62 being selectively stackable in an open-faced configuration having one crescent shaped handle, a plurality of hinges, and an anti-pinching means.

FIG. 63 is a full top view of the apparatus of FIG. 62 shown in an open-faced configuration having corresponding body sections 533 and 534, intersecting edges 302 and 402 respectively, cavities 531 and 532 respectively, a common handle 536, a plurality of hinges 530 attached to corresponding rails 517 that connect handle 536 to apparatus 533 and 534, a slot or aperture 188, not shown here on edge 402, to receive bendable barbs 538 to limit separable movement of sections 534 and 533.

Figure 64A:
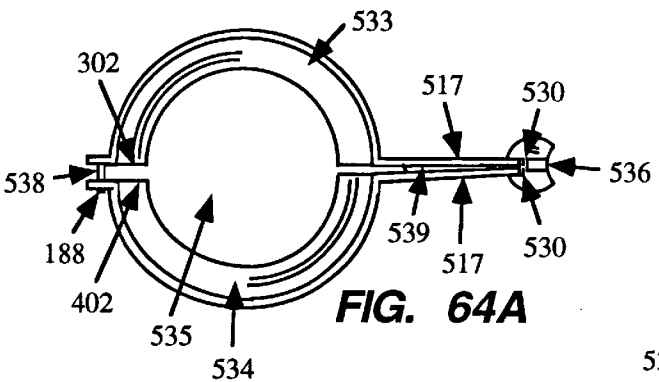
FIG. 64A is a full top view of the apparatus of FIG. 62 shown in a first position having a biasing means to urge the sections apart, a handle, a plurality of hinges, a plurality of sections that create a chamber, an anti-pinching means and a limiting means.

FIG. 64A is a full top view of the apparatus of FIG. 62 shown in a first, separated, or non-contacting position ready to create an audible sound or accept a container, having corresponding body sections 533 and 534, intersecting edges 302 and 402 respectively, cavities 531 and 532 respectively now create chamber 535, a common handle 536, a plurality of hinges 530 attached to corresponding rails 517 that connect handle 536 to apparatus 534 and 534, a slot or aperture 188 on edge 402, to receive bendable barbs 538 to limit separable movement of sections 534 and 533. Hinge sections 530 and 530 may be manufactured to create a biasing means to maintain sections 533 and 534 in a non-contacting position until a physical force is placed on apparatus to move sections 533 and 534 together to create an audible sound.

Figure 64C:
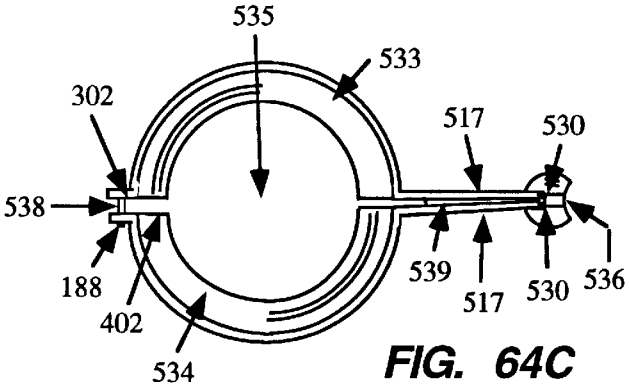
FIG. 64C is a full top view of the apparatus of FIG. 64B shown in a third position with the sections separated by a biasing means, ready to use again to create an audible sound.
Figure 64B:
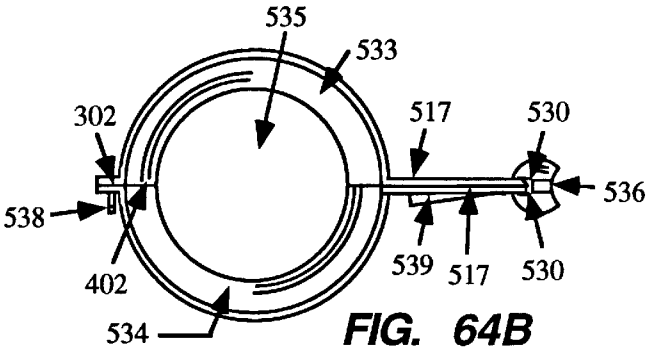
FIG. 64B is a full top view of the apparatus of FIG. 64A shown in a second position with the sections contacting, creating an audible sound.

FIG. 64B is a full top view of the apparatus of FIG. 64A shown in a second, closed, or contacting position creating an audible sound with a container removed, having corresponding body sections 533 and 534, intersecting at edges 302 and 402 respectively creating an audible sound, cavities 531 and 532 respectively now create chamber 535, a common handle 536, a plurality of hinges 530 attached to corresponding rails 517 that connect handle 536 to apparatus 534 and 534, slots or apertures 188 on edge 402, to receive bendable barbs 538 to limit separable movement of sections 534 and 533.

FIG. 64C is a full top view of the apparatus of FIG. 64B shown in a third, separated, or non-contacting position ready again to create an audible sound or accept a container, having corresponding body sections 533 and 534, intersecting edges 302 and 402 respectively, cavities 531 and 532 respectively now create chamber 535, a common handle 536, a plurality of hinges 530 attached to corresponding rails 517 that connect handle 536 to apparatus 534 and 534, slots or apertures 188 on edge 402, to receive bendable barbs 538 to limit separable movement of sections 534 and 533.

Figure 65:
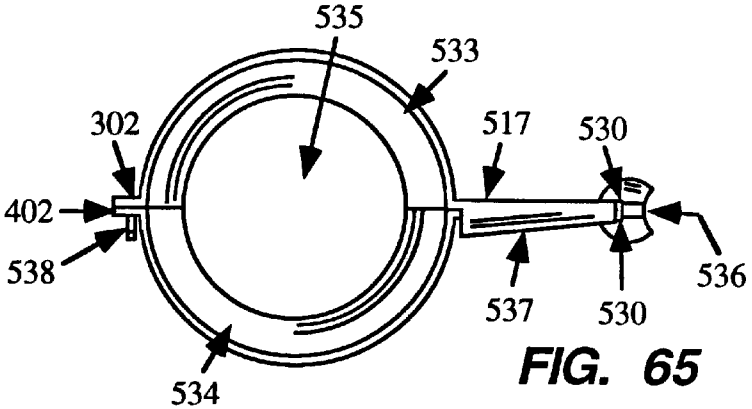
FIG. 65 is a full top view of the apparatus shown in FIG. 64B showing another embodiment of the anti-pinching means.

FIG. 65 is a full top view of the apparatus of FIG. 64A having a plurality of movable projections 537 that in unison with movable projections 539, create an anti-pinching means on two sides, top and bottom of rails 517, shown in FIG. 62. Apparatus 533 and 534 shown in a contacting position creating an audible sound with a container removed, intersecting at edges 302 and 402 respectively creating an audible sound, cavities 531 and 532 respectively now create chamber 535, a common handle 536, a plurality of hinges 530 attached to corresponding rails 517 v connect handle 536 to apparatus 534 and 534, slots or apertures 188, not shown here, on edge 402, to receive bendable barbs 538 to limit separable movement of sections 534 and 533.

A hidden message may be included on the openable or removable section of the openable bottom cup. This may be used to identify a prize in a contest or sweepstakes.

Figure 66:
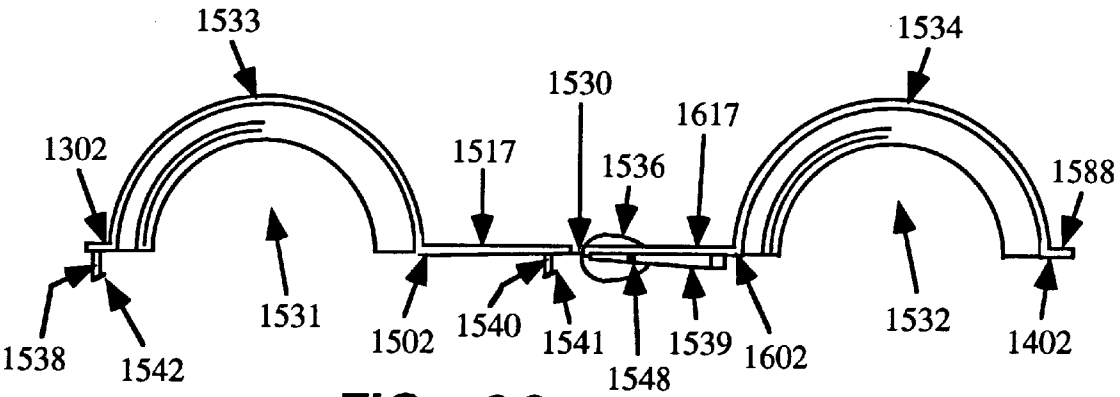
FIG. 66 is a full top view of the applause enhancing apparatus of the present invention being selectively stackable in an open-faced configuration having an ergonomically shaped handle, a plurality of hinges, an anti-pinching means, and rigid posts for selectively assembling the apparatus to form a megaphone or hold a cup or container.

FIG. 66 is a full top view of the present invention shown in an open-faced configuration having corresponding body sections 1533 and 1534, intersecting edges 1302 and 1402 respectively, cavities 1531 and 1532 respectively, a common ergonomically configured handle 1536 attached by a plurality of hinges 1530 to rails 1517 and 1617, an anti-pinching guard 1539 that encompasses the perimeter of corresponding rails 1517 and 1617that connect handle 1536 to apparatus 1534 and 1533 respectively, a slot or aperture 1588 on edge 1402 to receive rigid post 1538 with barbed end 1542 to limit separable movement of sections 1534 and 1533, and rigid post 1540 with barbed end 1541 to maintain sections 1533 and 1544 adjacent to each other in the event that hinge 1530 is broken. The post 1538 having a barbed end 1542 being insertable into the slot or aperture 1588 collectively comprise a latch member. Integral opening biasing means 1548 creates a biasing means to maintain sections 1533 and 1534 in a non-contacting position when sections 1533 and 1534 are assembled together. This embodiment is joined together by simply folding sections 1533 and 1534 together.

Figure 67:
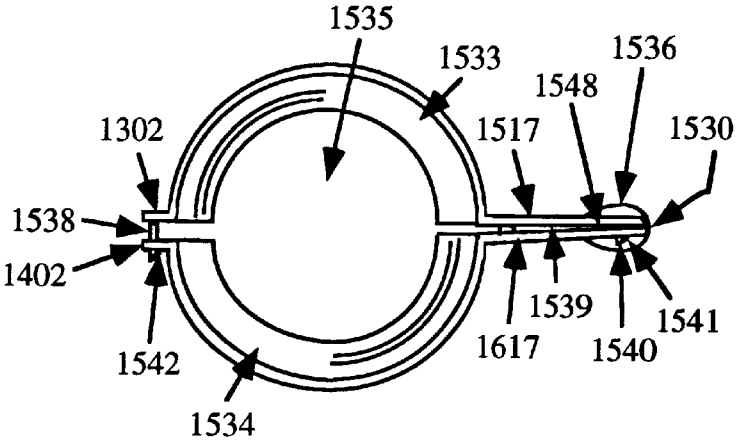
FIG. 67 is a full top view of the apparatus of FIG. 66 shown in a first position having a biasing means to urge the sections apart, a handle, a plurality of hinges, a plurality of sections that create a chamber, an anti-pinching means, and a rigid, fixed limiting means.

FIG. 67 is a full top view of the apparatus of FIG. 66 shown in a separated, or non-contacting position ready to create an audible sound or accept a container, having corresponding body sections 1533 and 1534, intersecting edges 3102 and 1402 respectively, cavities 1531 and 1532 respectively now create chamber 1535 when sections 1533 and 1534 are assembled together, a common handle 1536, a plurality of hinges 1530 attached to corresponding rails 1517 and 1617 that connect handle 1536 to apparatus 1534 and 1533 respectively, a slot or aperture 1588 on edge 1402, to receive rigid post 1538 with barb 1542 to limit separable movement of sections 1534 and 1533. Integral opening biasing means 1548 creates a biasing means to maintain sections 1533 and 1534 in a non-contacting position until a physical force is placed on apparatus to move sections 1533 and 1534 together to create an audible sound.

Figure 68:
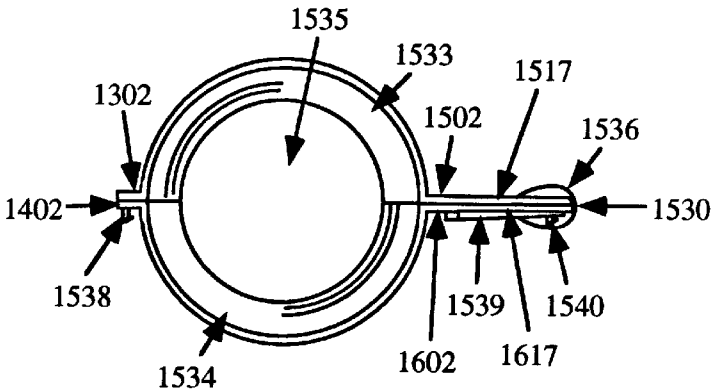
FIG. 68 is a full top view of the apparatus of FIG. 66 shown in a second position with the sections contacting, creating an audible sound.

FIG. 68 is a full top view of the apparatus of FIG. 67 shown in a contacting position, creating an audible sound when sections 1533 and 1534 strike against each other, having corresponding body sections 1533 and 1534, intersecting edges 1302 and 1402 respectively, cavities 1531 and 1532 respectively, now creating chamber 1535 when sections 1533 and 1534 are assembled together, a common handle 1536, a plurality of hinges 1530 attached to corresponding rails 1517 and 1617 that connect handle 1536 to apparatus 1534 and 1533 respectively, a slot or aperture 1588 on edge 1402, to receive rigid post 1538 with barb 1542 to limit separable movement of sections 1534 and 1533. Integral opening biasing means 1548 creates a biasing means to maintain sections 1533 and 1534 in a non-contacting position until a physical force is placed on apparatus to move sections 1533 and 1534 together to create an audible sound.

Figure 69:
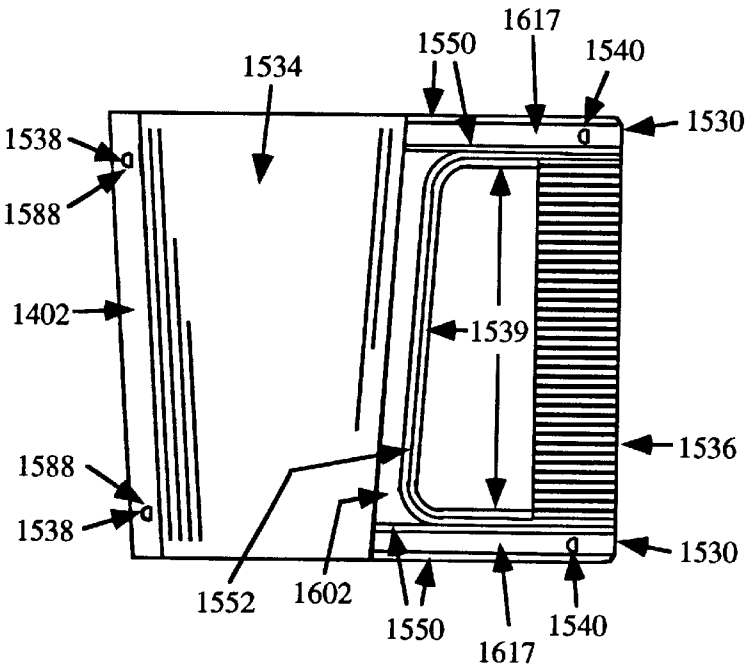
FIG. 69 is a full side view of FIG. 66 having a handle, a plurality of hinges, a limiting means, at least one projection that provides an anti-pinching means, and rigid posts for selectively assembling the apparatus to form a megaphone or hold a cup or container.

FIG. 69 is a full side view of the apparatus of FIG. 67 of the present invention shown with sections 1533 and 1534 joined together showing a wrap around embodiment of anti-pinching means guard 1539. Applause enhancing apparatus 1534 having a striking surface 1402, an ergonomically shaped handle 1536, and a plurality of hinges 1530 attached to corresponding rails 1617that connect handle 1536 to apparatus 1534. Rails having integral longitudinal protrusion or strongback 1550 to keep rails 1617 in a substantially flat configuration. Rigid posts 1540 on rails 1517 are inserted through apertures located on rails 1617 adjacent to handle 1536 to maintain sections 1533 and 1534 together. Apparatus having a limiting means comprising a plurality of rigid projections 1538 with barbs 1542that are selectively insertable into slots 1588. Rigid posts 1538 are manufactured substantially 900 relative to striking surfaces 1402 and 1302 and insertable in slots 1588 allowing separable sections 1533 and 1534, shown in subsequent drawings, to move back and forth to and from a non-contacting position to a contacting position, creating an audible sound. Connecting rails 1617 having striking surface 1602 adjacent to body 1534, a projection guard 1539 preventing user from pinching fingers or the like and space 1552 to keep sections 1533 and 1534 from binding during use as separable sections 1534 and 1533 move back and forth.

Figure 70:
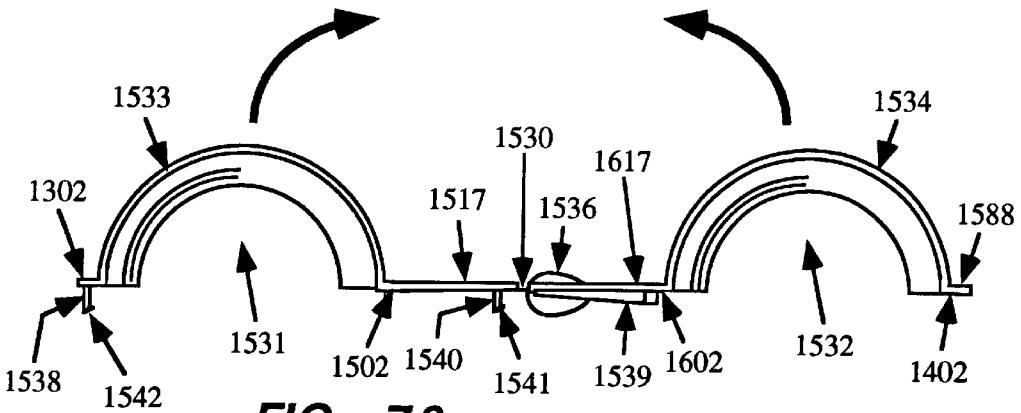
FIG. 70 is a full top view of the applause enhancing apparatus of the present invention shown in a single color in an open-faced configuration being selectively breakable at the hinge section prior to assembly.

FIG. 70 is a full top view of the present invention shown in an open-faced configuration having corresponding body sections 1533 and 1534 being bent to break connecting hinges 1530 to separate body sections 1533 and 1534 from each other allowing two differently colored sections to be assembled together to create a multi-colored applause enhancing apparatus. Body sections 1533 and 1534 now being separated at hinges 1530, having cavities 1531 and 1532 respectively, a common ergonomically configured handle 1536 connected to rails 1517 and 1617 having an anti-pinching guard 1539that encompasses the perimeter of corresponding rails 1517 and 1617 that connect handle 1536 to apparatus 1534 and 1533 respectively, a slot or aperture 1588 on edge 1402 to receive rigid post 1538 with barbed end 1542 to limit separable movement of sections 1534 and 1533, and rigid post 1540 with barbed end 1541 to maintain sections 1533 and 1544 adjacent to each other in the event that hinge 1530 is broken. Integral opening biasing means 1548 creates a biasing means to maintain sections 1533 and 1534 in a non-contacting position when sections 1533 and 1534 are assembled together.

Figure 71:
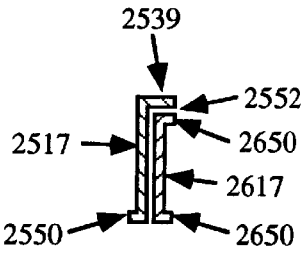
FIG. 71 is a full top view of the applause enhancing apparatus of the present invention shown in a single color with a broken hinge section, having two, separated sections.
Figure 71:
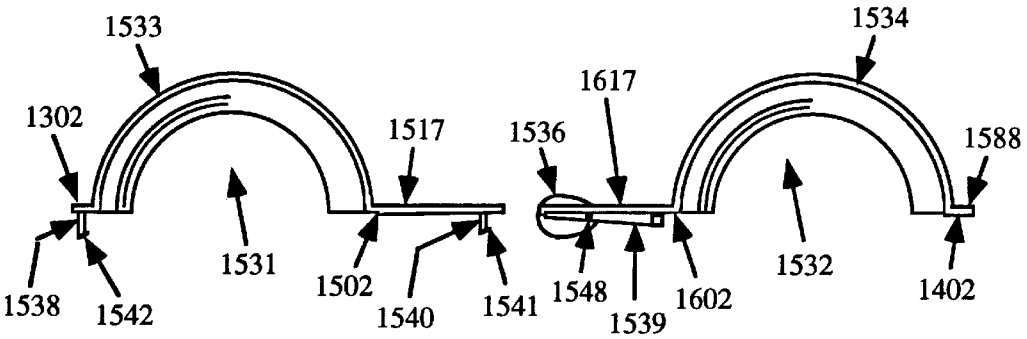

FIG. 71 is a full top view of the apparatus of FIG. 70 having body sections 1533 and 1534 being separated at hinge 1530 allowing two differently colored sections to be assembled together to create a multi-colored applause enhancing apparatus. Two body sections that are colored the same may also be joined together after being separated. Body sections 1533 and 1534 now separated at hinges 1530, having cavities 1531 and 1532 respectively, a common ergonomically configured handle 1536 connected to rails 1517 and 1617, having an anti-pinching guard 1539 that encompasses the perimeter of corresponding rails 1517 and 1617, a slot or aperture 1588 on edge 1402 to receive rigid post 1538 with barbed end 1542 to limit separable movement of sections 1534 and 1533, and rigid post 1540 with barbed end 1541 to maintain sections 1533 and 1544 adjacent to each other in the event that hinge 1530 is broken. The post 1540 with the barbed end 1541 is inserted into a slot of member 1534 collectively comprise a first latch member. Rigid post 1538 having barbed end 1542 disposed into slot 1588 collectively comprise a second latch member. Integral opening biasing means 1548 creates a biasing means to maintain sections 1533 and 1534 in a non-contacting position when sections 1533 and 1534 are assembled together.

Figure 72:
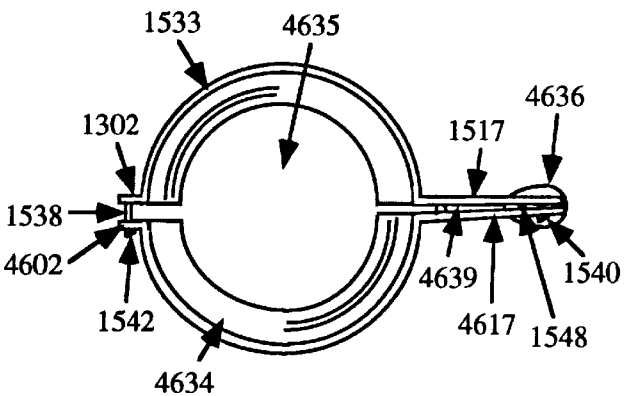
FIG. 72 is a full top view of the applause enhancing apparatus of the present invention comprising two, separate colored sections.

FIG. 72 is a full top view of the applause enhancing apparatus of the present invention having differently colored body sections 1533 and 4634 assembled together to create a multi-colored applause enhancing apparatus. Two body sections that are colored the same may also be joined together after being separated. Body sections 1533 and 4634 joined together by rigid posts 1538 and 1540 now creating cavity 4635 to hold a container and create a megaphone. A common ergonomically configured handle 4636 connected to rails 4617, having an anti-pinching guard 4639 that encompasses the perimeter of corresponding rails 4617, a slot or aperture 4688 on edge 4602 to receive rigid post 1538 with barbed end 1542 to limit separable movement of sections 1533 and 4634, and rigid post 1540 with barbed end 1541 to maintain sections 1533 and 4634 adjacent to each because hinges 1530 are broken. Integral opening biasing means 1548 creates a biasing means to maintain sections 1533 and 4634 in a non-contacting position when sections 1533 and 4634 are assembled together.

Figure 73:
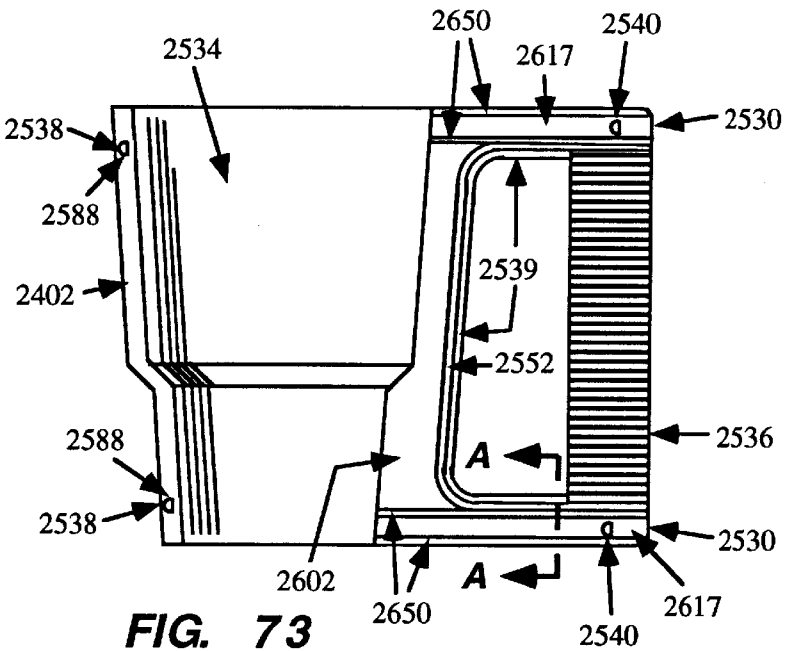
FIG. 73 is a full side view of the applause enhancing apparatus of the present invention comprising a means to hold a container or cup having a change in profile.

FIG. 73 is a full side view of the applause enhancing apparatus of the present invention shown with body sections having a change in profile. This embodiment allows containers with variable shapes to be used with the applause enhancing apparatus. Many cups are manufactured with a smaller base, relative to the upper body section, so a large capacity cup can be inserted into a stationary cup holder in a vehicle or into an arm rest. Applause enhancing apparatus 2534 having a striking surface 2402, an ergonomically shaped handle 2536, and a plurality of hinges 2530 attached to corresponding rails 2617 that connect handle 2536 to apparatus 2534. Rails 2617 having integral longitudinal protrusion or strongback 2650 to keep rails 2617 in a substantially flat configuration. Rigid posts 2540 on rails 2617 are inserted through apertures located on rails 2617 adjacent to handle 2536 to maintain sections 2533, not shown, and 2534 together. Apparatus having a limiting means comprising a plurality of rigid projections 2538 with barbs 2542 that are selectively insertable into slots 2688. Rigid posts 2538 are manufactured substantially 90° relative to striking surfaces 2402 and 2302, not shown, and insertable in slots 2588 allowing separable sections 2533 and 2534, to move back and forth to and from a non-contacting position to a contacting position, creating an audible sound. Connecting rails 2617 having striking surface 2602 adjacent to body 2534, a projection guard 2539 preventing user from pinching fingers or the like and space 2552 to keep sections 2533 and 2534 from binding during use as separable sections 2534 and 2533 move back and forth.

FIG. AA is a cross sectional view of the present invention of section AA of FIG. 73 showing rails 2517 and 2617 having longitudinal protrusions, or strongbacks, 2550 and 2650 respectively, separated by space 2552 and an anti-pinching guard 2539 that protects a user's hand and fingers when separable sections 2533 and 2534 move back and forth.

FIG. 74 is a full side view of the applause enhancing apparatus of the present invention shown with a slot, or opening 3646 to allow apparatus to be inserted into a cup holder in a car or arm rest. Applause enhancing apparatus having sections 3633, not shown, and 3634 joined together showing a wrap around embodiment of anti-pinching guard 3539. Applause enhancing apparatus 3634 having a striking surface 3602, an ergonomically shaped handle 3636, and a plurality of hinges 3630 attached to corresponding rails 3617 that connect handle 3636 to apparatus 3634. Rigid posts 3640 on rails 3617 are inserted through apertures located on rails 3617 adjacent to handle 3636 to maintain sections 3633, not shown, and 3634 together. Apparatus having a limiting means comprising a plurality of rigid projections 3638 with barbs 3642 that are selectively insertable into apertures 3688. Rigid posts 3638 are manufactured substantially 90° relative to striking surfaces 3602 and 3402, not shown, and insertable in slots 3688 allowing separable sections 3633 and 3634, to move back and forth to and from a non-contacting position to a contacting position, creating an audible sound. Connecting rails 3617 having striking surface 3602 adjacent to body 3634, a projection guard 3539 preventing user from pinching fingers or the like and space 3652 to keep sections 3633 and 3634 from binding during use as separable sections 3634 and 3633 move back and forth. Connecting rail 3617 having a void, or recess, 3646 to allow apparatus to nest, or be inserted in a stationary cup holder in a vehicle or an arm rest at a stadium.

FIG. 75 is a cut away view of the applause enhancing apparatus of the present invention having an adjustable means to hold containers of similar, but varying, sizes and shapes. Even though containers or cups may have the same volumetric capacity, the sizes and shapes vary from manufacturer to manufacturer and even from lot to lot. Applause enhancing apparatus 1533 and 1534 having a striking surfaces 1302 and 1402 respectively, being assembled with rigid limiting post 1538 inserted through aperture 1588 to hold cup 110 with cavity 113 and bottom 112. Since there are two limiting posts, 1538 at the top and bottom of the apparatus 1533 and 1534 respectively, any cup inserted into apparatus will move the posts 1538 to a full extending position and self-adjust to fit the varying shaped cup or container. An separate, annular spacer sleeve may also be placed over the small cup prior to insertion in apparatus 1533 and 1534 to provide a means to securely hold small cup within apparatus.

FIG. 76 is a cut away view of the applause enhancing apparatus of the present invention having an selectively adjustable means to hold smaller containers that would be normally too small to be properly held by apparatus 1533 and 1534. Applause enhancing apparatus 1533 and 1534 having a striking surfaces 1302 and 1402 respectively, being assembled with rigid limiting post 1538 inserted through aperture 1588 to hold cup 1110 with bottom 1112. Selectively movable portion 1107 may be positioned within apparatus 1534 to allow a smaller container 1110 to properly seat within larger apparatus 1533 and 1534. When selectively moveable portion 1107 is positioned within apparatus 1534, an aperture, or opening 1106 is created in side wall of apparatus 1534.

Referring particularly to the embodiments shown in FIGS. 66–76, in operation, to use as a cup holder, sections are folded together to create a cup holder by inserting and locking each of the four connector pins through the corresponding holes. The sections must be properly joined together before using. A 20 to 24 oz. fountain cup or a 16 to 24 oz plastic cup may be placed in the tubular body to allow consumption of a beverage. Because the beverage container now includes a handle, the user's hands will not be cold from direct contact with the beverage container.

For use as a hand clapper, the fountain cup or plastic cup must be removed from the device. The cup is held by the handle and struck against the free hand, like clapping. For one handed use, the device is slapped against a leg. The device may also be used as a megaphone by holding the cup by the handle and placing the smaller opening near the mouth and shouting and speaking therein. Because the hinges are breakable, the device may be mated with other cups of different colors to achieve color combinations.

What is claimed is:

1. An apparatus for holding beverage containers and generating noise comprising:

a tubular body and u-shaped handle wherein said tubular body and u-shaped handle are longitudinally split defining first and second components;

said first and second components interconnected at the handle by at least one hinge such that said first and second components are transitional between;

i) a first opened configuration; and ii) a second closed configuration wherein said first and second components are operative to assume a tubular body and adapted to receive a beverage container positionable therein; and a latch member on said tubular body to releasably cause said first and second components to remain securely in said second configuration wherein said latch member sufficiently spaces said first and second components such that the two components can be slapped together to generate a clapping sound when no beverage container is engaged therewith.

2. The apparatus of claim 1 wherein said first and second components are formed in a mirror image configuration.

3. The apparatus of claim 1 wherein said tubular body has a tapered configuration such that of the diameter of the cylinder decreases from the top to the bottom of said tubular body.

4. The apparatus of claim 1 further comprising a second latch member positioned on the handle to further secure said first and second components.

5. The apparatus of claim 1 further comprising a bendable flange in the side wall of the tubular body wherein a user can manually adjust the flang inwardly to engage and secure varying sizes of beverage containers.

6. The apparatus of claim 1 wherein said hinge is breakable to separate the first and second components.

7. An apparatus for holding beverage containers and generating noise comprising:

a tubular body and u-shaped handle wherein said tubular body and u-shaped handle are longitudinally split defining first and second components;

said first and second components interconnected at the handle by a first latch member positioned at the handle; and a second latch member to releasably cause said first and second components to remain securely in a closed configuration operative to assume a tubular body wherein said second latch member sufficiently spaces said first and second components such that the two components can be slapped together to generate a clapping sound when no beverage container is engaged therewith.

8. The apparatus of claim 7 wherein said first and second components are formed in a mirror image configuration.

9. The apparatus of claim 7 wherein said tubular body has a tapered configuration such that of the diameter of the cylinder decreases from the top to the bottom of said tubular body.

10. The apparatus of claim 7 further comprising a bendable flange in the side wall of the tubular body wherein a user can manually adjust the flange inwardly to engage and secure varying sizes of beverage containers.

* * * * *